US007156515B2

(12) United States Patent
Iwata

(10) Patent No.: US 7,156,515 B2
(45) Date of Patent: Jan. 2, 2007

(54) LIQUID MATERIAL DISCHARGING METHOD, LIQUID MATERIAL DISCHARGING APPARATUS, AND ELECTRONIC DEVICE MANUFACTURED THEREBY

(75) Inventor: Yuji Iwata, Suwa (JP)

(73) Assignee: Seiko Epson Corporation (JP)

( * ) Notice: Subject to any disclaimer, the term of this patent is extended or adjusted under 35 U.S.C. 154(b) by 262 days.

(21) Appl. No.: 10/701,156

(22) Filed: Nov. 4, 2003

(65) Prior Publication Data

US 2004/0140330 A1 Jul. 22, 2004

(30) Foreign Application Priority Data

Nov. 8, 2002 (JP) ..... 2002-325356
Nov. 28, 2002 (JP) ..... 2002-344778
Jul. 22, 2003 (JP) ..... 2003-199893

(51) Int. Cl.
*B41J 2/01* (2006.01)
*B41J 11/00* (2006.01)
*B41J 2/415* (2006.01)

(52) U.S. Cl. ..... 347/102; 347/100; 347/125

(58) Field of Classification Search ..... 347/100–102, 347/15, 43, 105, 125, 128; 392/417; 34/266–267, 34/273; 219/216
See application file for complete search history.

(56) References Cited

U.S. PATENT DOCUMENTS 5,847,723 A * 12/1998 Akahira et al. ..... 347/14
6,439,712 B1 * 8/2002 Mizutani et al. ..... 347/102

FOREIGN PATENT DOCUMENTS

| | | |
|---|---|---|
| JP | 4-57280 | 5/1992 |
| JP | 06-246910 | 9/1994 |
| JP | 08-117668 | 5/1996 |
| JP | 09-010658 | 1/1997 |
| JP | 11-281810 | 10/1999 |
| JP | 2000-288442 | 10/2000 |
| JP | 2001-234356 | 8/2001 |
| JP | 2002-169013 | 6/2002 |

OTHER PUBLICATIONS

Communication from Korean Patent Office re: related application.
Communication from Japanese Patent Office re: related application.
Communication from Japanese Patent Office regarding related application.

* cited by examiner

*Primary Examiner*—Shih-Wen Hsieh
(74) *Attorney, Agent, or Firm*—Harness, Dickey & Pierce, P.L.C.

(57) ABSTRACT

A discharging apparatus has a substrate holding part 32 which holds a substrate S; an discharging head 34 which discharges a liquid material onto the substrate S; an ion producing device 38 which provides an ionized wind on the substrate S; an exhaust device 40 which is placed on a direction where the ionized wind from the ionized wind producing device 38 is blowing, and the ionized wind is provided toward the liquid material on the substrate S, at least, immediately after discharging the liquid material onto the substrate S.

7 Claims, 13 Drawing Sheets

LIQUID MATERIAL DISCHARGING METHOD, LIQUID MATERIAL DISCHARGING APPARATUS, AND ELECTRONIC DEVICE MANUFACTURED THEREBY

CROSS REFERENCE TO RELATED APPLICATIONS

Priority is claimed on Japanese Patent Application No. 2002-325356, filed on Nov. 8, 2002; Japanese Patent Application No. 2002-344778, filed on Nov. 28, 2002; and Japanese Patent Application No. 2003-199893, filed on Jul. 22, 2003; and the contents thereof are incorporated herein by reference.

BACKGROUND OF THE INVENTION

1. Field of the Invention

The present invention relates to a discharging method for discharging a liquid material. In particular, the invention relates to a discharging method for a liquid material, to a discharging apparatus for a liquid material, and to an electronic device which can be manufactured thereby, which enhance uniformity of thickness of a film made by a discharged liquid material, and moreover, which prevents defects caused by static electrical charge of constituent elements on the substrate, which is easily electrostatically charged, or to a constituent elements to be formed on the substrate, which easily electrostatically charged.

2. Description of Related Art

Conventionally, as a discharging apparatus which is equipped with a discharging head which discharges a liquid material, an ink jet printer is known which is equipped with an ink jet head.

Typically, the ink jet head which is equipped on the ink jet printer, comprises a cavity which stores the liquid material, and a nozzle which is open to the cavity, and a discharging device which discharges the liquid material being stored in the cavity through the nozzle. In addition, a liquid material tank which stores liquid material is connected to the discharging head, and a liquid material is provided from this liquid material tank to the discharging head.

In addition, recently, not only for an commercial use ink jet printers, the ink jet head is also used as an industrial use discharging apparatus, that is, an apparatus which makes constituent elements of a wide variety of apparatuses. For example, the discharging head is used for forming color filters for liquid crystal apparatuses, etc., for light emission layers and for positive hole injection layers in organic EL element apparatuses, and in addition, for metal wiring of a wide variety of devices, microlenses, etc.

Here, in the case in which the ink jet head is used for manufacture of a color filter such as a crystal liquid apparatus, because the substrate is made of glass, the substrate may easily become charged, and in the case in which a color filter material jetted on a region which is charged, so-called "flight path curvature" may be occur, by which a discharged liquid droplet impacts a location which differs from the desired location.

Therefore, a color filter manufacturing method which avoids alteration of the impact point of liquid droplets by reducing the flight path curvature (for example, refer to Japanese Patent Application No. 11-281810 is desired.).

In this color filter manufacturing method, electrical charge on a substrate is neutralized by blowing ionized gas on the substrate before discharging a color filter material (ink), because the purpose is only to avoid charging the substrate itself. This is because the substrate is made of a material, such as glass, which easily becomes charged.

However, in the manufacturing process of a wide variety of devices other than color filter manufacturing, by charging an element except the substrate, for example, constituent elements of a device which are formed on the substrate, there may be a problem in that the element will be damaged or destroyed by electrostatic charge, or the ink jet head (discharging head) will be damaged or destroyed by the charge of the element.

No prior technology is provided for preventing charge build-up of the element except for the substrate itself.

Moreover, normally, at the ink jet head (discharging head), in the case in which a wide variety of films such as color film as a constituent elements of a device is formed, a thing which film material which is a solid component is dissolved or dispersed in a solvent is used. This is for adding fluidity to the film material and enables it to be provided to the nozzle, and to be discharged though the nozzle.

Therefore, by discharging a liquid material including a solvent or dispersing media on a substrate, and after coating it in thin film style, transferring it to a drying process, and conducting drying processing which evaporates the solvent and the dispersing media using a hot air furnace, hot plate, infrared radiation furnace, etc., forming it into film style constituent elements.

However, in the film made of the liquid material, evaporation of the solvent and the dispersing media occurs immediately after being coated on the substrate, and preliminary evaporation occurs before transferring it into the drying process. At the preliminary evaporation under atmospheric conditions, near the surface of the film, concentration of the solvent (dispersing media) steam evaporated from the film is high above the center portion and is relatively low at the periphery.

Then, the evaporation proceeds slowly at the center portion, and on the other hand, the evaporation proceeds relatively faster at the portion around it, and this causes circulation of the solvent (dispersing media) from the center portion side to the portion side around it. In the case in which circulation occurs, a part of the solid content (film material) moves from the center portion to the periphery, and as a result, film thickness at the portion around the center portion becomes thicker than the center portion.

Therefore, as might be expected, uniformity of the film thickness of entire of the film gotten after the drying process is lost, thus, dispersion of function in the constituent elements occurs, and this results in one cause which reduces the reliability.

In addition, like a color filter and an organic EL, in the case in which a number of films on a substrate by discharging an ink into a cell which is demarcated for each pixel, the center portion of the cell becomes concave if the drying period is short, while the center portion of the cell becomes convex if the drying period is relatively long. Therefore, in the case of viewing the entire substrate, convex shaped cells are clustered toward the center portion, whereas concave shaped cells are clustered around the periphery, and this causes variation in luminance of the panel.

SUMMARY OF THE INVENTION

The present invention was made in view of the above and an object thereof is to provide a discharging method for a liquid material and a discharging apparatus for a liquid material which enhances uniformity of thickness of a film made of a discharged liquid material, which prevent problems caused by electrostatic charge to an easily chargeable constituent elements which has been formed or which will be formed on a substrate, but not to the substrate itself, and to provide an electronic device which was made using the discharging method for a liquid material and a discharging apparatus for a liquid material.

To achieve this object, a discharging method for a liquid material of the present invention is a discharging method for a liquid material which discharges a liquid material on a substrate from a discharging apparatus of the liquid material having a discharging head which discharges the liquid material; at least after discharging the liquid material onto the substrate, an ionized wind is directed toward the liquid material on the substrate.

According to the discharging method for a liquid material, because the ionized wind is directed toward the liquid material on the substrate after discharging the liquid material on the substrate, evaporated chemicals will be immediately removed from above the substrate by the ionized wind in spite of solvents and dispersing media being evaporated from the liquid material. Therefore, concentration gradients of solvent vapor or of dispersing media between the above of the center portion and of the area therearound will not be produced, and this can prevent the production of variations in film thickness caused by concentration differences. Thus, this can avoid variability of functions of constituent elements caused by loss of uniformity of film thickness, and can prevent loss of reliability. Moreover, this can also prevent non-uniformity of panel luminance.

In addition, by providing an ionized wind onto the substrate, electrostatic charge on the substrate can be neutralized, and problems in which constituent elements are charged or the discharging head is destroyed by electrostatic charge on the substrate, can be prevented.

In addition, according to the discharging method for a liquid material, in the case in which the substrate comprises an easily chargeable constituent elements, it is preferable that an ionized wind be directed toward the substrate before discharging the liquid material.

In this case, it is possible to neutralize electrical charge on the substrate reliably, and it is also possible to neutralize electrical charge on the easily chargeable constituent elements before discharging the liquid material. Therefore, the easily chargeable constituent elements can be prevented from being damaged or destroyed. The discharging head can also be prevented from being damaged or destroyed by the charging of the constituent elements, etc.

Moreover, according to the discharging method for a liquid material, the easily chargeable constituent elements can be an active element.

In the case in which the easily chargeable constituent elements is the active element having, for example, a TFT (Thin Film Transistor) etc., by directing an ionized wind toward it, damage or destruction due to static electricity can be prevented. Therefore, improvement in productivity of a product which is made using this substrate, and improvement in the reliability thereof can be achieved.

In addition, according to the discharging method for a liquid material, in the case in which the liquid material is made of easily chargeable constituent elements, it is preferable to direct an ionized wind toward the substrate before discharging the liquid material.

In this case, it is possible to neutralize electrical charge on the substrate reliably, it is also possible to prevent electrostatic buildup on the easily chargeable liquid material itself being discharged. Therefore, electrostatic build up on the constituent elements formed of the easily chargeable liquid material can be avoided. Furthermore, a problem of the discharging head being damaged or destroyed by charging of the constituent elements, etc., can also be avoided.

Moreover, according to the discharging method for a liquid material, the liquid material composed of the easily chargeable material can be a metal wiring material.

In the case in which the liquid material is made of the wiring material such as, for example, metal colloidal material etc., by directing an ionized wind toward this, charging thereof can be prevented, and thus, a metal wiring may be formed in which charging thereof can be avoided. Therefore, it is possible to improve productivity of a product which is made using this substrate and to improve the reliability.

In another discharging method for a liquid material of the present invention, when discharging a liquid material onto a substrate having an easily chargeable constituent elements, an ionized wind is provided toward the substrate at least before discharging the liquid material.

According to this discharging method for a liquid material, because the ionized wind is directed toward the substrate having the easily chargeable constituent elements at least before discharging the liquid material, it is possible to neutralize electrostatic charge of the substrate reliably, it is also possible to neutralize electrostatic charge of the easily chargeable constituent elements. Therefore, damage or destruction of the easily chargeable element by electrostatic charge can be avoided. Furthermore, it is also possible to avoid a problem that the discharging head being damaged or destroyed due to electrostatic charge of constituent elements.

In addition, according to the discharging method for a liquid material, the easily chargeable constituent elements can be an active element.

In the case in which the easily chargeable constituent elements is the active element having, for example, a TFT (Thin Film Transistor), etc., by directing an ionized wind thereto, the electrostatic damage and destruction can be avoided. Therefore, it is possible to improve productivity of a product which is made using this substrate and to improve reliability.

The discharging apparatus for a liquid material of the present invention includes a substrate holding part which holds a substrate having an easily chargeable constituent elements; a discharging head which discharges the liquid material onto the substrate; and an ionized wind producing device which produces an ionized wind onto the substrate.

According to this discharging apparatus for a liquid material, at least before discharging the liquid material, by producing the ionized wind from the ionized wind producing device and directing the ionized wind to the substrate having the easily chargeable constituent elements, it is possible to neutralize electrostatic charge of the substrate itself reliably, and it is also possible to neutralize electrostatic charge of the easily chargeable constituent elements. Therefore, damage or destruction of the easily chargeable element may be avoided. The problem of the discharging head being damaged or destroyed due to charging of the constituent elements can be avoided.

Another discharging apparatus for a liquid material of the present invention includes a substrate holding part which holds a substrate; a discharging head which discharges the liquid material which is an easily chargeable material onto the substrate; and an ionized wind producing device which produces an ionized wind and directs the ionized wind onto the substrate.

According to this discharging apparatus for a liquid material, by producing the ionized wind from the ionized wind producing device and directing the ionized wind to the substrate before discharging the liquid material composed of the easily chargeable material onto the substrate, it is possible to neutralize electrostatic charge on the substrate itself, and moreover, it is also possible to prevent charging of the liquid material which is easily chargeable. Therefore, charging of the constituent elements formed of the easily chargeable liquid material can be avoided. A problem can also bet prevented in which the discharging head is damaged or destroyed due to charging of the constituent elements.

Another discharging apparatus for a liquid material of the present invention includes a substrate holding part which holds a substrate; a discharging head which discharges the liquid material onto the substrate; an ionized wind producing device which produces an ionized wind and directs the ionized wind onto the substrate; and an exhaust device which is provided along a direction in which the ionized wind from the ionized wind producing device is blowing.

According to this discharging apparatus for a liquid material, for example, immediately after discharging the liquid material onto the substrate, by providing the ionized wind to the liquid material on the substrate, and by exhausting solvent vapors or dispersing media vapors being introduced by this ionized wind using the exhaust device, the solvent vapors or dispersing media vapors from the liquid material can be immediately removed from above the substrate. Therefore, concentration gradients in the solvent vapors or dispersing media vapors between above the center portion and the periphery will not be produced, and this can prevent production of variation in film thickness due to the concentration differences. Thus, variation in functions of constituent elements due to loss of uniformity of film thickness can be avoided, and loss of reliability can be avoided. Moreover, this can also prevent non-uniformity of panel luminance.

In addition, by providing the ionized wind to the substrate, it is possible to neutralize electrostatic charge of the substrate itself, and electrostatic charge of the constituent elements to be formed by the electrostatic charge on the substrate can be avoided. A problem in which the discharging head is damaged or destroyed can therefore be avoided.

The electronic device of the present invention is one in which one part of the constituent elements is formed using the discharging method for a liquid material or the discharging apparatus.

The electronic device can be highly reliable and is desirable because it is formed using a substrate which avoids variation in function of constituent elements due to non-uniformity of formed film thickness, or with a substrate which prevents loss of reliability. The device can also be highly reliable and is desirable because damage to or destruction of the easily chargeable constituent elements can be avoided. The device can also be highly reliable and is desirable because it is formed using a substrate with constituent elements being formed of an easily chargeable liquid material for which the electrostatic charge thereof was avoided.

DETAILED DESCRIPTION OF THE INVENTION

The present invention will be explained below.

Figure 1:
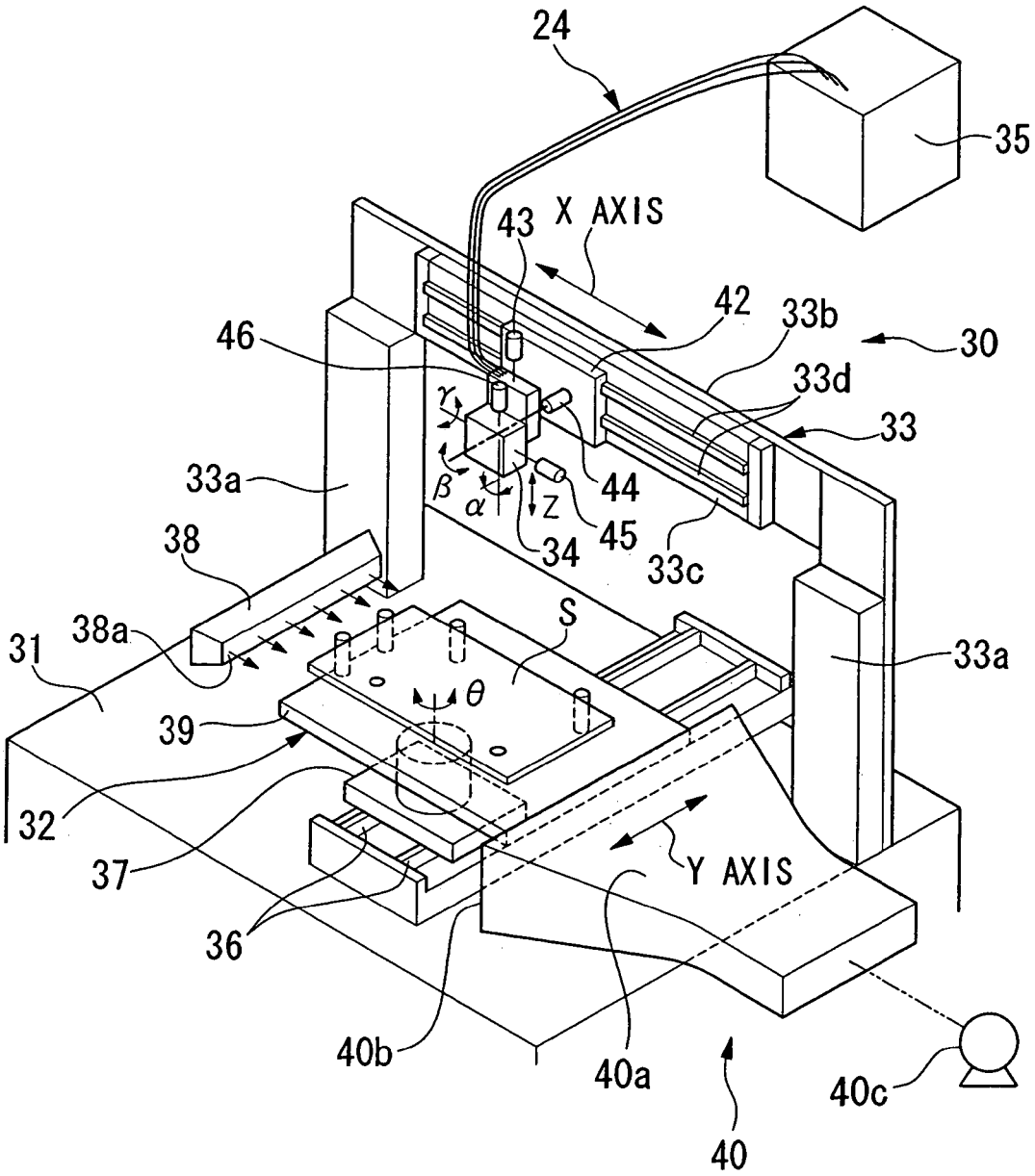
FIG. 1 shows schematically the constitution of a discharging apparatus of the present invention.

FIG. 1 shows one embodiment of a discharging apparatus for a liquid material of the present invention (called a discharging apparatus below). In FIG. 1, the reference symbol 30 denotes a discharging head. The discharging apparatus 30 has a base 31, a substrate transfer device 32, a head transfer device 33, a discharging head 34, a liquid material tank 35, an ion producing device 38, an exhaust device 40, etc., and the discharging apparatus 30 discharges a liquid material from the discharging head 34 toward the substrate S and coats the liquid material thereon in a film. Moreover, in the discharging apparatus 34 of the present embodiment, a constituent elements which is easily chargeable is used for the substrate S or an easily chargeable material is used for the liquid material.

The base 31 is provided with the substrate transfer device 32 and the head transfer device 33 thereon.

The substrate transfer device 32 acts as a substrate holding device of the present invention, that is, a substrate holding part which is for holding the substrate S. The substrate transfer device 32 also has a guide rail 36. In this constitution, the substrate transfer device 32 transfers a slider 37 along the guide rail 36 by, for example, a linear motor. The slider 37 has a motor for the θ axis (not shown). This motor is, for example, a direct drive motor, and the rotor (not shown) is fixed to a table 39. In this constitution, when electrical power is provided to the motor, the rotor and the table 39 rotate along the θ direction, and indexes (rotation index) the table 39.

The table 39 is for fixing the position and holding it. That is, the table 39 has a known suction and holding device (not shown), and by driving it, suction and holding the substrate S on the table 39 is conducted.

The substrate S is precisely placed and fixed in position at a predetermined location on the table 39 by a position-fixing pin, then is held thereon. On the table 39, a dust shot area (not shown) is provided for a dust shot or a trial shot of an ink from the discharging head 34. In the present embodiment, this dust shot area is formed so as to extend along the X-axis direction, and is provided on the back part side of the table 39.

The head transfer device 33 has a pair of pedestals 33*a* and 33*a* which are standing on the back part side of the base 31, and a running road 33*b* which is provided on the above of these pedestals 33*a* and 33*a*. The head transfer device 33 is placed along the X-axis direction, that is, along a direction which crosses at right angles with the Y-axis direction of the substrate transfer device 32. The running road 33*b* is formed by having a holding plate 33*c* built between the pedestals 33*a* and 33*a*, and a pair of guide rails 33*d* and 33*d* provided on the holding plate 33*c*. Furthermore, a slider 42 which holds the discharging head 34 is held so that it can move along the extending direction of the guide rails 33*a* and 33*a*. The slider 42 runs on the guide rails 33*d* and 33*d* by drive of a linear, motor, etc. (not shown), and with this, the slider 42 is constituted so as to make the discharging head 34 move along the X-axis direction.

Motors 43, 44, 45, and 46 as an oscillation position fixing devices are connected to the discharging head 34. When the motor 43 is activated, the discharging head 34 moves upward and downward along the Z-axis, and thus a position fixing can be performed on the Z-axis. Moreover, the Z-axis is a direction (up and down direction) which crosses at right angles with the X-axis and Y-axis. In addition, when the motor 44 is activated, the discharging head 34 oscillates along the β direction in FIG. 1, and thus a position fixing can be performed. When the motor 45 is activated, the discharging head 34 oscillates along the γ direction, and thus a position fixing can be performed. When the motor 46 is activated, the discharging head 34 oscillates along the α direction, and thus a position fixing can be performed.

On the slider 42, the discharging head 34 can fix the position by moving directly along the Z-axis direction, and also can fix the position by traveling along the α, β, and γ directions. Therefore, a position or a attitude of an ink discharging face of the discharging head 34 against the substrate S on the table 39 side can be precisely controlled.

Figure 2A:
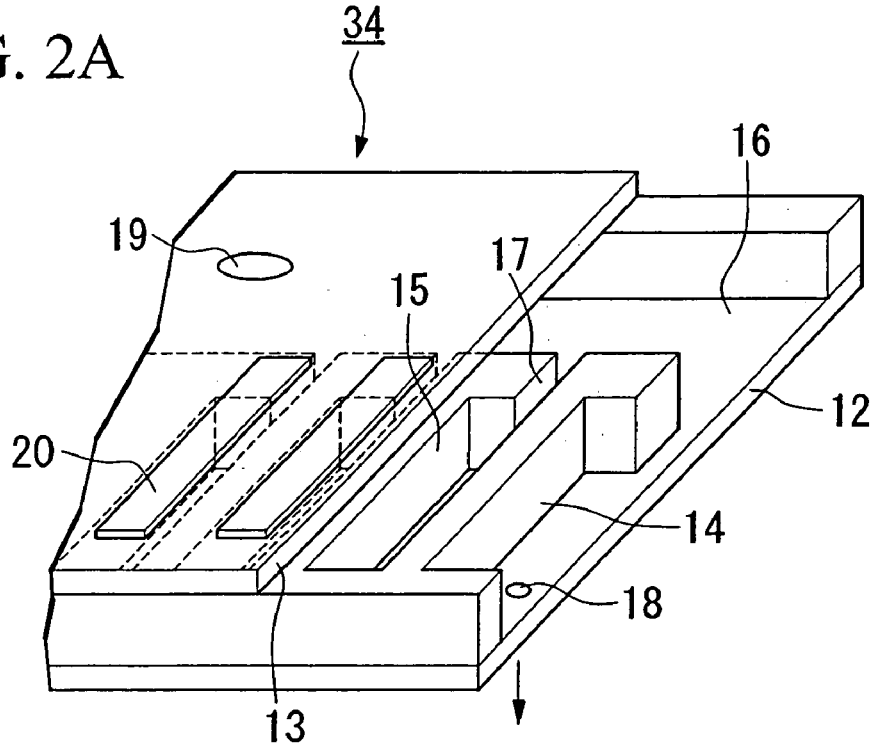
FIGS. 2A and 2B show schematically the constitution of a discharging head.

As shown in FIG. 2A, the discharging head 34 has a nozzle plate 12 and a vibration plating 13 which, for example, are made of stainless steel material, and combining them while interposing an separation part (reservoir plate) 14 therebetween. Between the nozzle plate 12 and the vibration plating 13, a plurality of cavities 15 and reservoirs 16 are formed by the separation parts 14, and these cavities 15 and reservoirs 16 are connected through paths 17.

The interiors of each cavity 15 and the reservoir 16 can be filled with a liquid material, and the path 17 between them acts as a supply path which supplies the liquid material from the reservoir 16 to the cavity 15. In addition, a plurality of hole-shaped nozzles 18 for discharging a liquid material from the cavity 15 are formed in a state in which they are aligned vertically and horizontally. On the other hand, at the vibration plating 13, a hole 19 which is open to the inside of the reservoir 16 is formed, and a liquid material tank 35 is connected to the hole 19 via a tube 24 (refer to FIG. 1).

Figure 2B:
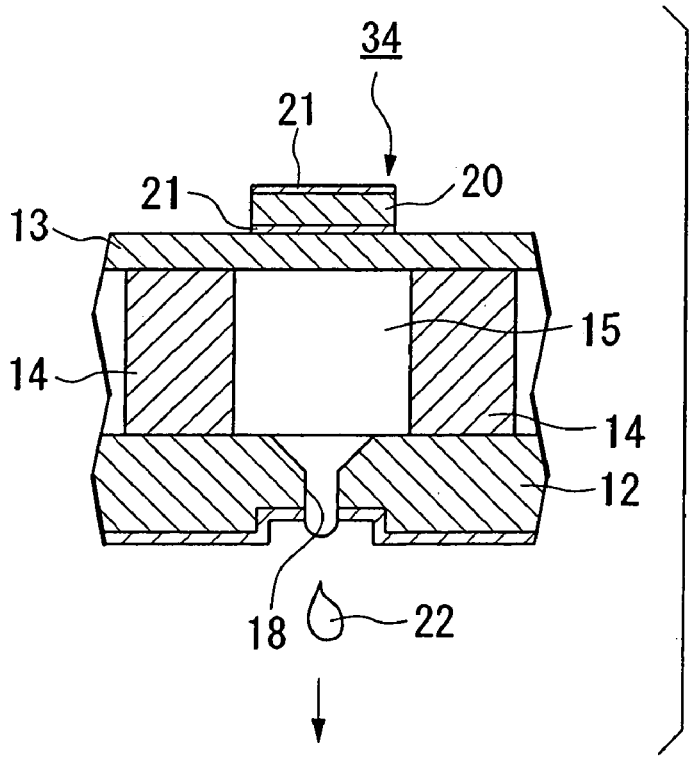

In addition, on the face of the vibration plating 13 which is opposite side of the face facing the vibration plate 15, a piezoelectric element 20 is connected, as shown in FIG. 2B. The piezoelectric element 20 is sandwiched between a pair of electrodes 21 and 21, and is constituted so that it bends flexibly and protrudes to outside by a electrical power supply. The piezoelectric element 20 acts as a discharging device of the present invention.

In this constitution, the vibration plating 13 which is connected to the piezoelectric element 20 bends flexibly toward the outside acting as one unit with the piezoelectric element 20 at the same time, and by doing this, the capacity inside the cavity 15 increases. Then, because the interiors of the cavity 15 and reservoir 16 are open to each other, in the case in which the interior of the reservoir 16 is filled with a liquid material, the liquid material which is equal to the increased volume in the cavity 15 flows into the reservoir 16 via the path 17.

If power supplied to the piezoelectric element 20 is stopped in such a state, the shapes of the piezoelectric element 20 and the vibration plating 13 return to their original shape. Therefore, because the volume in the cavity 15 returns to the original volume, the pressure of the liquid material inside the cavity 15 increases, and then a liquid droplet 22 of the liquid material is discharged from the nozzle 18.

Moreover, as a discharging device of the discharging head, the methods other than an electromechanical conversion method which uses the piezoelectric element 20 can be adopted. For example, a method which uses the electrothermal conversion body as an energy producing element, a continuous method such as the electrification control method, and the pressurization vibration method, the static aspiration method, and further a method which heats up by irradiating electromagnetic waves such as a laser, and discharging a liquid material by the work of the heat, can be adopted.

As shown in FIG. 1, the liquid material tank 35 is placed near the discharging head 34, and stores a liquid material of constituent elements formed by discharging it. A heater (not shown) is equipped inside or outside of the liquid material tank 35. This heater is for heating a liquid material which is stored, particularly, in the case in which the liquid material has high viscosity characteristics, etc., reducing the viscosity by heating, then making the liquid material easy to flow into the discharging head 34 from the liquid material tank 35.

The ion producing device 38 is for producing an ionized wind, and is constituted by, for example, an ionizer or an ion blower. Here, the ionized wind is an ionized gas flow which is made by blowing air or $N_2$ at the ions produced by corona discharge at the edge of discharging stings. The ion producing device 38 of the present invention can provide a sufficient quantity of ions by providing many discharging stings. In addition, as for the air source or the $N_2$ source which are for blowing at the ions produced by the corona discharge, known sources such as compressed air from an compressor, air or $N_2$ filled in a gas cylinder, etc., can be adopted. In the present invention, as described in below, preliminary drying is conducted as a result of providing the ionized wind. Therefore, it is acceptable to make the ionized wind as a hot wind which is above room temperature by providing a heater on the flow path from the air source or $N_2$ source.

In addition, the ion producing device 38 is placed at one side of the substrate S on the base 31, that is, one of the sides along X-axis of the substrate S on the table 39 as shown in FIG. 1. The blowing exit port 38*a* is placed facing to the surface of the substrate S so that produced ionized wind can blow over the entirely of the substrate S, especially onto the surface of the substrate S. As for the ion producing device 38, it is possible to attach it to a transfer device which transfers it, and transferring the ion producing device 38 relatively to the substrate S along the length direction (Y-axis direction) or along the width direction (X-axis direction) of the substrate S by the motion of the transfer device, so that sufficient and uniform ionized wind can be blown onto the surface of the substrate S.

The quantity of the ionized wind blown (flow rate) from the ion producing device 38 has no special limitations, but is set to be as much as being desired corresponding to the size of the substrate S, etc. That is, the flow rate is set to be nearly uniform over the entire surface of the substrate S, and furthermore, as is described later, the flow rate is set to a quantity (flow rate) sufficient to remove vapors which are produced from the solvent or dispersing media in the liquid material discharged, together with the ionized wind.

In addition, the ionized wind from the ion producing device 38 does not only act for drying, but also, as a matter of course, acts to discharge electricity, that is, the ionized wind acts to discharge electrostatic charge on the substrate S, etc. A discharging method using an ionized wind is a very preferable discharging method because it does not contact against the substrate S, and will not make scratches or bring dust onto the substrate S. Therefore, although providing (blowing) an ionized wind onto the substrate S is conducted at least before discharging a liquid material or immediately after discharging it, it is preferable to conduct blowing at both of times. Furthermore, as long as no problem occurs at the discharging head 34 or in discharging liquid droplets from it, it is more preferable to conduct the blowing simultaneously with the discharging of a liquid material.

The exhaust device 40 has a known exhaust structure such as exhaust duct, etc., and in the present example, it has an exhaust duct 40*a*, and suction pump 40*c* connected to the exhaust duct 40*a*. The exhaust duct 40*a* is placed so that its exhaust inlet 40*b* faces the direction of which an ionized wind is blowing from the ion producing device 38. That is, the exhaust duct 40*a* is placed at the opposite side of the blowing exit port 38*a* of the ion producing device 38 via the substrate S, and the exhaust inlet 40*b* is placed so that it faces he blowing exit port 38*a* of the ion producing device 38. Under this constitution, when the ion producing device 38 is activated and an ionized wind is blown from the blowing exit port 38*a*, as is described later, the exhaust device 40 draws solvent (dispersing media) vapors companioned by the ionized wind and exhausts them by activating the suction pump 40*c*.

Moreover, concerning the suction power of the suction pump 40*c* at the exhaust device 40, it is sufficient to draw an ionized wind from the ion producing device 38 and a solvent (dispersing media) companioned by the ionized wind immediately and exhaust them, while it is not preferable to utilize strong suction power which causes flow in the liquid material on the substrate S.

Next, one example of a discharging method for a liquid material of the present invention will be explained based on the action of the discharging apparatus 30 which has this kind of constitution. In the present invention, a substrate S provided with an easily chargeable material will be used, and also an easily chargeable material will be used for the liquid material.

First, the substrate S on the substrate transfer device 32 is placed at a location which corresponds to a substrate holding part in the present invention and is then held and fixed on the substrate transfer device 32.

When the substrate S is set by doing the above, an ionized wind is produced by the ion producing device 38 and the produced ionized wind is blown onto the entirely of the substrate S before discharging a liquid material from the discharging head 34. In the case in which the ion producing device 38 is attached to the transfer device, blowing of an ionized wind from the blowing exit port 38*a* while moving the ion producing device 38 appropriately so that an ionized wind is provided over the entirely of the substrate S, especially on the surface uniformly.

Then, electrostatic charge on the substrate itself can be discharged, and furthermore, electrostatic charge on the easily chargeable constituent elements formed on the substrates S such as, for example, an active element constituted by TFT (Thin Film Transistor) etc., and electrostatic charge on a metal wiring which is already formed also can be discharged. If no discharging is performed using an ionized wind, the potential of the substrate S will be about 5 kV to 30 kV, while by performing a process to provide an ionized wind, the potential of the substrate S can be equal to or lower than 1 kV.

Moreover, at the time blowing an ionized wind, the suction pump 40*c* of the exhaust device 40 can be activated, or may be not activated.

Next, by transferring the discharging head 34 to the proper location for discharging, and furthermore, by discharging from the discharging head 34 while transferring the substrate S using the substrate transfer device, a metal wiring material made of a liquid material such as a metal colloid material is formed in a film on the desired location of the substrate S. Moreover, during the discharging process for a liquid material, as long as no problem occurs in the discharging of a liquid material, it is preferable to continue blowing an ionized wind from the ion producing device 38. However, disturbance of discharging the liquid material should be avoided by stopping the action of the suction pump 40*c* of the exhaust device 40.

When discharging a liquid material like this, because a process to discharge electrostatic charge on the substrate S is already performed as mentioned above, electrostatic charging of the easily chargeable material discharged from the discharging head 34 can be avoided, and furthermore, damage of or destruction of the discharging head 34 caused by electrostatic charge on the substrate S, etc., can be avoided. In addition, in the case of continuous blowing of an ionized wind from the ion producing device 38 during discharging work of a liquid material, electrostatic charging of the substrate S during the discharging work can be avoided, and also electrostatic charging of the liquid material discharged on the substrate S can be avoided.

In this way, when a predetermined quantity of liquid material is applied on each of the predetermined locations so as to form a desired film, the discharging is completed. Then, activation of the ion producing device 38 and blowing of an ionized wind toward the liquid material on the substrate S are performed immediately after finishing the discharging. At the same time, the suction pump 40*c* of the exhaust device 40 is activated. In the case in which an ionized wind is blown from the ion producing device 38 during the discharging work of a liquid material, the ionized wind is continuously blown as it is, and the suction pump 40*c* of the exhaust device 40 is newly activated.

Then, a solvent (dispersing media) vapors from a liquid material which is discharged and coated on the substrate S will be removed immediately by the ionized wind from the location above the substrate S, and the vapor is exhausted from the exhaust port 40*c*. Therefore, a concentration difference of a steam of the solvent (dispersing media) between at the above of the center portion of the substrate S and at above the periphery disappears, and this avoids irregularity in the formed film caused by the concentration difference.

In addition, by blowing an ionized wind toward the substrate S, electrostatic charge on the substrate S will be discharged in the case in which, for example, an ionized wind is not provided on the substrate S before the discharging and the substrate S itself is charged.

By blowing an ionized wind in this way, the solvent (dispersing media) contained in the liquid material on the substrate S will be evaporated and removed as vapor, then it has been preliminarily dried.

After this, conducting this kind of preliminary drying for a predetermined time, and for example, when the vapor producing rate per unit time from the film (liquid material) becomes low which is sufficient not to affect the film thickness, the substrate S is transferred to the drying process. Next, a constituent elements in a film is formed by conducting a drying process using a hot air furnace or a hot plate, an infrared irradiation furnace, a vacuum drying furnace, etc., and evaporating a solvent or dispersing media remaining in the film.

In the discharging method for a liquid material using this kind of discharging apparatus 30, because an ionized wind is blown toward the liquid material on the substrate S immediately after discharging the liquid material on the substrate S, as described above, concentration gradients in the solvent (dispersing media) vapor between that above of the center portion of the substrate S and that above of the periphery disappears, and therefore, nonuniformity of the film thickness caused by the concentration gradients can be prevented. Therefore, variation in the functions of the constituent elements caused by loss of uniformity of film thickness and loss of reliability can be prevented.

In addition, by providing an ionized wind onto the substrate S, electrostatic charge on the substrate S itself can be discharged, and then problems in which a constituent elements to be formed is charged by electrostatic charge on the substrate S, or the discharging head 34 is damaged or destroyed, etc., can be prevented.

In addition, because an ionized wind is blown toward the substrate S before discharging a liquid material, electrostatic charge on the substrate itself can be discharged, and furthermore, electrostatic charge on the easily chargeable constituent elements formed on the substrate S, for example, an active element made of TFT (Thin Film Transistor) also can be discharged. Therefore, the active element, etc., being damaged or destroyed by electrostatic charge can be avoided, and furthermore, the discharging head 34 being damaged or is destroyed by the charge, etc., can also be avoided.

In addition, when a liquid material is discharged, because electrostatic charge on the substrate S is already discharged, electrostatic charging on the discharged liquid material which is easily chargeable can be prevented. Furthermore, because the ionized wind is provided on the liquid material (film) immediately after discharging a liquid material, charging on the constituent elements formed by the easily chargeable material such as, for example, metal wiring can be prevented. Furthermore, a problem in that the discharging head 34 is destroyed caused by discharging on constituent elements (metal wiring), etc., can also be prevented.

Therefore, according to the discharging method for a liquid material using the discharging apparatus 30, variability in functions of constituent elements caused by loss of uniformity of film thickness can be avoided, and loss of reliability can be avoided. Furthermore, it can increase the reliability by enhancing a productivity of the products formed using the substrate S which is made by discharging a liquid material.

Furthermore, the present invention is not limited to the aforementioned embodiments, but rather can naturally be altered in various ways within a range that does not deviate from the spirit of the present invention. For example, the discharging apparatus 30 in the present invention, although not shown in figures, may be entirely accommodated in a chamber, or alternatively, at least, the substrate S, discharging head 34, and the ion producing device 38 may be accommodated in chamber, an exhaust inlet 40*b* of the exhaust device 40 may be provided in the chamber.

In addition, in the present embodiment, an active element such as a TFT is shown as an example of an easily chargeable constituent material, and also a metal wiring material such as a metal colloid material is shown as an example of a liquid material made of an easily chargeable material. However, the present invention is not limited to these, and a wide variety of others can be used as the easily chargeable constituent material, or as the liquid material made of an easily chargeable material. For example, as for the easily chargeable constituent material, it is possible to apply to aforementioned metal wiring, a wide variety of memory elements, an organic EL element, an organic TFT element, etc. As for a liquid material made of an easily chargeable material, it is possible to use a liquid material made of conductive fine particles which are dispersed and to a conductive resin material such as, for example, a conductive color filter material, etc.

Next, as a first application example, a manufacturing example of an organic EL apparatus will be explained.

Figure 3:
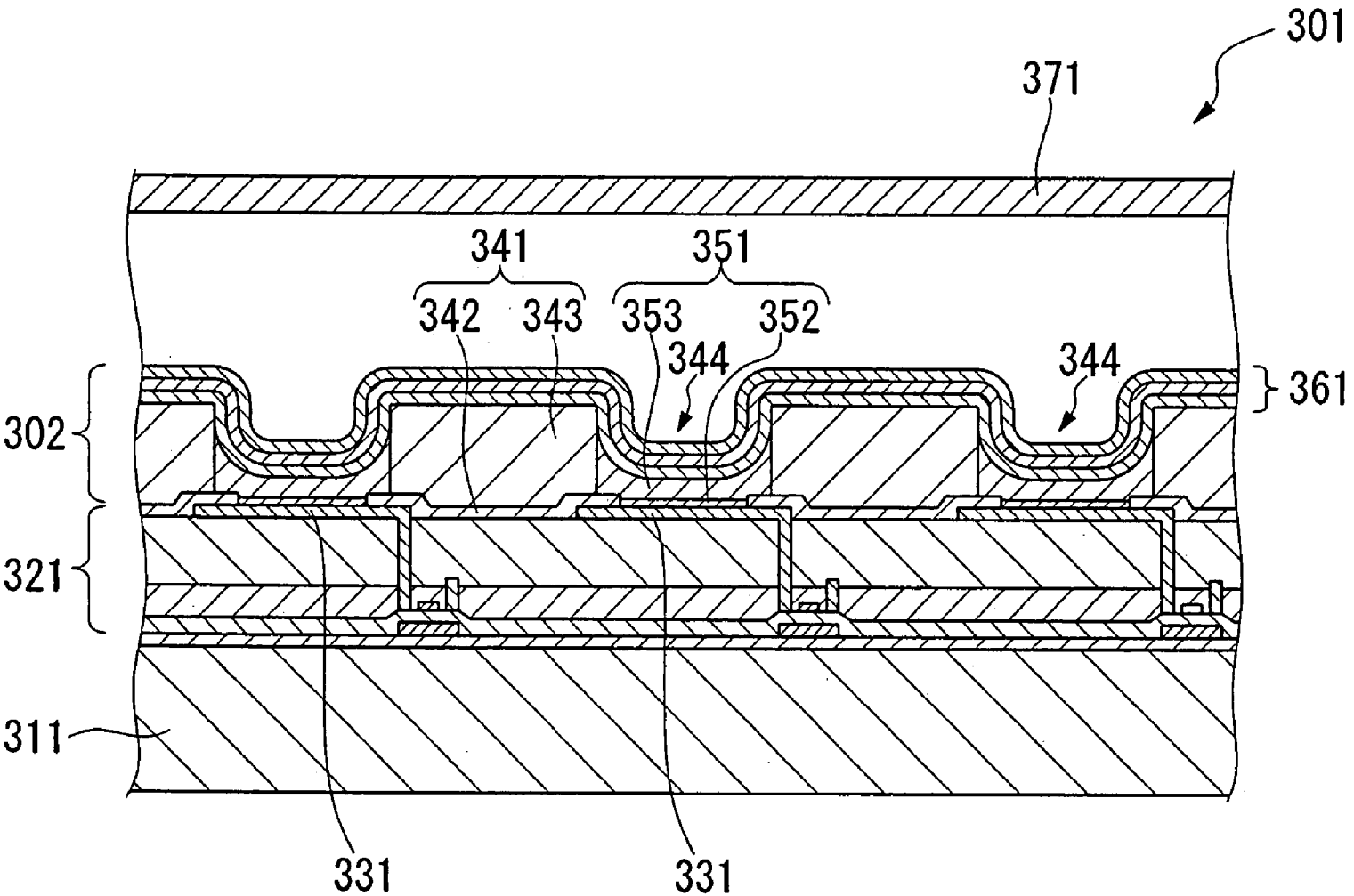
FIG. 3 shows a side sectional view of an organic EL apparatus.

FIG. 3 shows a side sectional view of an organic EL apparatus of which one part of the constituent elements is manufactured by the discharging apparatus. First, the schematic configuration of the organic EL apparatus will be explained.

As shown in the FIG. 3, the organic EL apparatus 301 is an organic EL element 302 of which a wiring of a flexible substrate (not shown) and a driver IC (not shown) are connected, and the organic EL element 302 has a substrate 311, a circuit element part 321, a pixel electrode 331, a bank part 341, a light emitting element 351, a cathode 361 (opposing electrode), and an enclosing substrate 371. The circuit element section 321 is made of an active element such as a TFT, etc., formed on the substrate 311, and is also constituted so that plural pixel electrodes 331 are arranged on the circuit element part 321. Between pixel electrodes 331, a bank part 341 is formed in a matrix, and the light-emitting element 351 is formed in the concave shaped open port 344 which is made by the bank part 341. The light-emitting element 351 has an element which emits red light, an element which emits green light, and an element which emits blue light. With this constitution, the organic EL apparatus 301 can realize full color display. The cathode 361 is formed entirely on the top surface of the bank part 341 and the light-emitting element 351, and the enclosing substrate 371 is layered above of the cathode 361.

A manufacturing process of the organic EL apparatus 301 which includes an organic EL element has a bank part forming process which forms the bank part 341, a plasma processing process which is for forming the light emitting element 351 properly, a light emitting element forming process which forms the light emitting element 351, an opposing electrode forming process which forms the cathode 361, and an enclosing process which layers the enclosing substrate 371 on the cathode 361 and encloses it.

The light emitting element forming process is for forming the light emitting element 351 by forming a positive hole injection layer 352 and light emitting layer 353 on the pixel electrode 331, and it has a positive hole injection layer forming process and a light emitting layer forming process. The positive hole injection layer forming process has a first discharging process which discharges a liquid material on the pixel electrode 331 for forming the positive hole injection layer 352, and a first drying process which dries the discharged liquid material and forms the positive hole injection layer 352. In addition, the light emitting layer forming process has a second discharging process which discharges a liquid material for forming the light emitting layer 353 on the positive hole injection layer 352, and a second drying process which dries the discharged liquid material and forms the light emitting layer 353. The light emitting layer 353 is made to emit the three colors red, green, and blue as mentioned in the above. Therefore, the second drying process has three processes for discharging three type of materials.

In the light emitting element forming process, the discharging apparatus 30 is used for the first discharging process at the positive hole injection layer forming process, and also it is used for the second discharging process at the light emitting layer forming process. That is, in the first discharging process, an ionized wind will be provided from the ion producing device 38 before and after the liquid material is discharged, and furthermore, when the liquid material is discharged at the three process of the second discharging process, an ionized wind will be provided before and after the discharging.

In the manufacture of the organic EL apparatus 301, before discharging for forming each constituent elements, electrostatic charge on the substrate 311, and electrostatic charge on the pixel electrode 331 and the circuit element part 321 will be discharged by providing an ionized wind from the ion producing device 38 to the substrate 311, that is, to the substrate 311 of which an easily chargeable constituent elements such as the circuit element part 321 and pixel electrode 331 is performed. In addition, immediately after the positive hole injection layer forming process and the light emitting layer forming process, an ionized wind will be provided onto the liquid material charged on the substrate 311.

By doing this, electrostatic damage or destruction of the discharging head 34 can be prevented, and furthermore, the productivity of the produced organic EL apparatus 301 can be enhanced, and also the reliability can be enhanced.

In addition, as for the positive hole injection layer 352 and the light emitting layer 353 to be formed, because the film thickness can be uniform, it is possible to eliminate variability in function and enhance reliability.

Next, as a second application of the present invention, a plasma display will be explained.

Figure 4:
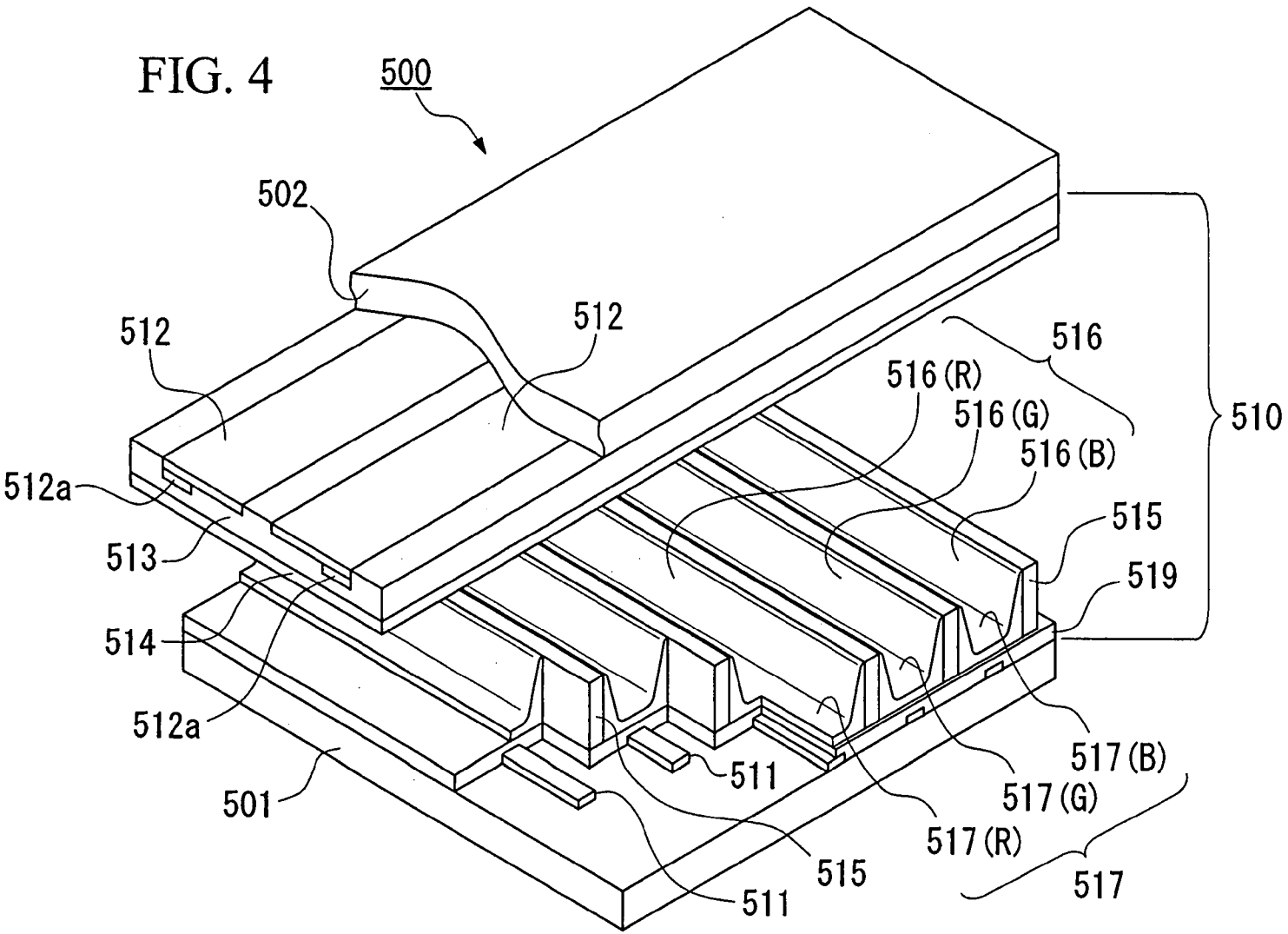
FIG. 4 shows an exploded perspective view of a plasma display.

FIG. 4 is a figure showing an exploded and perspective view of a plasma display in which one part of the constituent elements, that is, an address electrode 511 and a bus electrode 512*a* are manufactured by the discharging apparatus. The reference symbol 500 in FIG. 4 denotes a plasma display. The plasma display is generally constituted of a glass substrate 501 and a glass substrate 502 which are placed so as to oppose each other, and a discharging display part 510 formed therebetween.

The discharging display part 510 has a group of plural discharging chambers 516. Within the plural discharging chambers 516, three discharging chambers 516 are placed so that a red color discharging chamber 516(R), a green color discharging chamber 516(G), and a blue discharging chamber 516(B) make one group and constitute one pixel.

On the top surface of the substrate (glass) 501, address electrodes 511 are formed in stripes with a predetermined gap therebetween, and dielectric layer 519 is formed so that it covers the top surfaces of the address electrode 511 and the substrate 501, and furthermore, on the dielectric layer 519, banks 515 are formed between the address electrodes 511 and 511 so that they extend along the each address electrode 511. The banks 515 are also partitioned in the perpendicular direction at the predetermined location on its extending direction with a predetermined gap (not shown), and rectangular shaped regions are basically formed by demarcating by the banks which are aligned so that they are adjacent to both the left and right sides in the width direction of the address electrode 511 and the banks which is provided and extending in perpendicular direction to the address electrodes 511 (not shown), and the discharging chambers 516 are formed so that they correspond to these rectangular shaped regions, and one pixel is constituted by three of the rectangular shaped regions in one group. A fluorescent material 517 is placed inside the rectangular regions demarcated by the banks 515. The fluorescent material 517 emits one of red, green, and blue fluorescent lights, and the red colored fluorescent material 517(R) is placed on the bottom of a red colored discharging chambers 516(R), and the green colored fluorescent material 517(G) is placed on the bottom of a green colored discharging chambers 516(G), and the blue colored fluorescent material 517(B) is placed on the bottom of a blue colored discharging chambers 516(B).

On the side of the glass substrate 502, transparent display electrodes 512 made of a plurality of ITOs which are aligned so that the direction is perpendicular to the address electrode 511 are formed in stripes with a predetermined gap therebetween. Also, bus electrodes 512*a* made of metal are formed to compensate the high resistance ITOs. In addition, a dielectric layer 513 will be formed by coating these, and furthermore, a protection film 514 such as MgO, etc., will be formed.

The discharging chambers 516 are formed by mounting the substrate 501 and the glass substrate 502 mutually so that the address electrodes 511 and the display electrodes 512 are opposing and are perpendicular to each other, and by evacuating the space surrounded by the substrate 501 and banks 515 and the protection film 514 formed on the side of glass substrate 502, and by filling the space with an inert gas. The display electrodes 512 formed on the glass substrate 502 side are formed so that two of them are placed corresponding to each of the discharging chambers 516.

The address electrodes 511 and the display electrodes 512 are connected to the AC (Alternating Current) power supply, which is not shown in figures, and by providing electrical power to these address electrodes 511 and display electrodes 512, the fluorescent materials 517 at the necessary location of discharging display part 510 are excited and emit light, and thus a color display can be realized.

In the present example, in particular, the address electrode 511 and the bus electrodes 512*a* are formed using the discharging apparatus 30. That is, in the case of forming these address electrodes 511 and bus electrodes 512*a*, as it has a special advantage for the patterning, a liquid material which contains a metal colloid material (for example, gold colloid and silver colloid) or a conductive fine particles (for example, metal fine particles) being dispersed therein is discharged, and it is formed by drying and sintering.

In this case, applying the present invention, electrostatic charge on the substrate 501 (the glass substrate 502) is discharged by blowing an ionized wind from the ion producing device 38 toward the substrate 501 or to the glass substrate 502 in advance. In addition, by providing an ionized wind immediately after the discharging of the electrode material, the film thickness of electrodes to be formed will be uniform and charging of the electrodes to be formed can be avoided.

With this, uniformity of the film thickness of the address electrodes 511 and the bus electrodes 512*a* being formed can be enhanced, and it is possible to form them so that the function does not have variability and has high reliability.

In addition, it is possible to prevent an electrostatic destruction of the discharging head 34, and furthermore, a productivity of the plasma display being produced can be enhanced, and also the reliability can be enhanced.

Next, as a third application of the present invention, a manufacturing example of an electric device which is equipped with a light emitting diode and an organic TFT will be explained.

Figure 5:
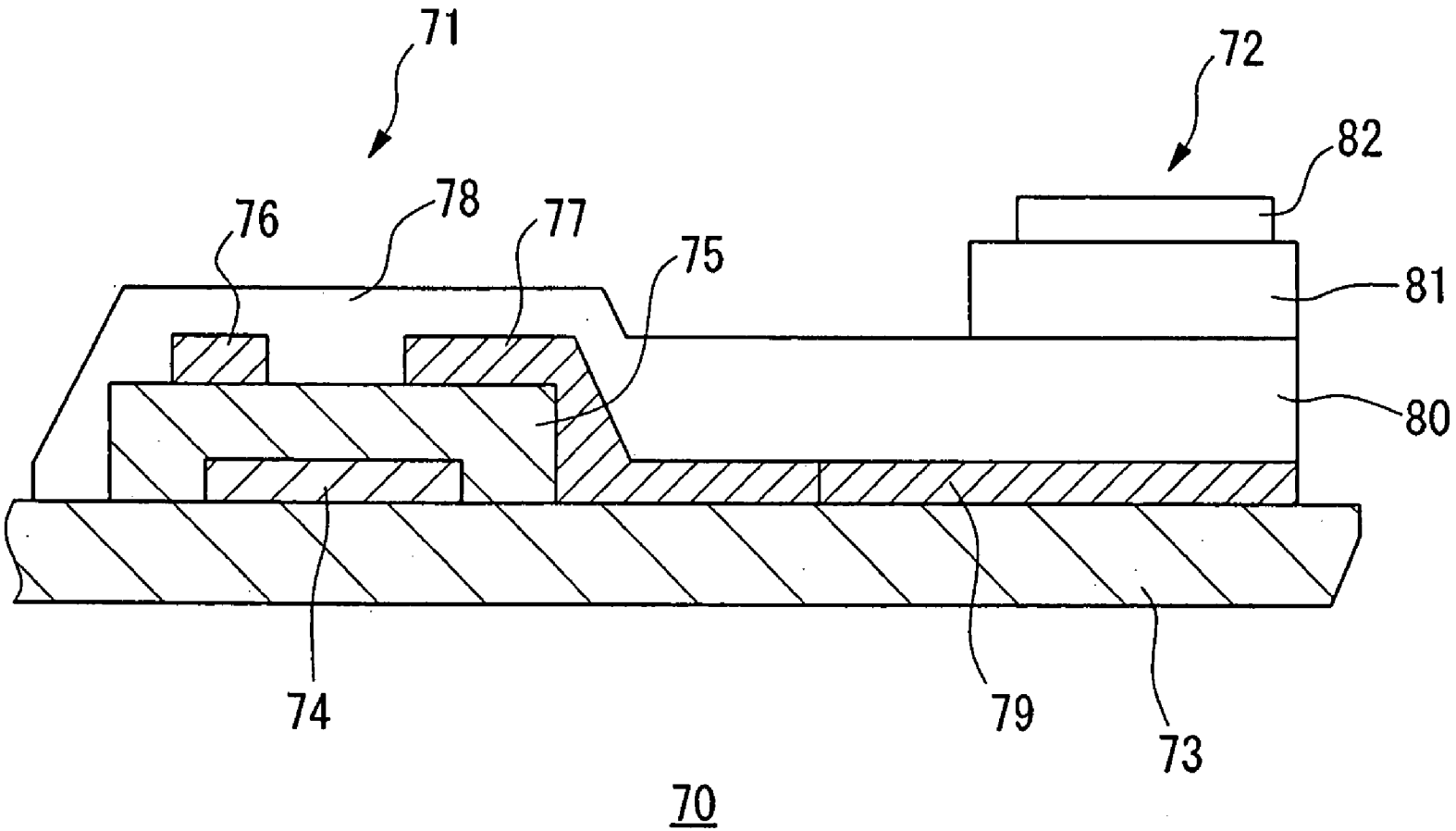
FIG. 5 shows a side sectional view of an electronic device.

FIG. 5 is a side sectional view of an electronic device of which one part of the constituent elements is manufactured by the discharging apparatus. An electronic device 70 is made by integrating the organic TFT 71 and the organic LED 72 onto the same substrate 73 in monolithic. The organic TFT includes a gate electrode 74 formed on the substrate 73, a dielectric layer 75 formed by covering this, a source electrode 76 and drain electrode 77 formed on the dielectric layer 75, and an organic semiconductor layer 78 formed by covering these electrodes.

The organic LED 72 includes an anode 79 formed on the substrate 73, a positive hole transfer layer 80 formed by covering the anode 79, an electron transfer layer 81 formed on the positive hole transfer layer 80, and a cathode 82 formed on this electron transfer/emitter layer 81. The anode 79 is formed by extending the drain electrode 77 above the substrate 73, and the positive hole transfer layer 80 is formed by extending the organic semiconductor layer 78 above the anode 79.

At the electronic device 70, in the case of forming, for example, the anode 79 and cathode 82 using metal, etc., the discharging apparatus 30 is preferably used for the manufacture. That is, in the case of forming the anode 79 and cathode 82, as it has a special advantage for the patterning, a liquid material which contains a metal colloid material (for example, gold colloid and silver colloid) or conductive fine particles (for example, metal fine particles) being dispersed therein is discharged, and it is formed by drying and sintering.

In this case, applying the present invention, electrostatic charge on the substrate 73, further charged on the organic TFT 71, is discharged by blowing an ionized wind from the ion producing device 38 toward the substrate 73 in advance. In addition, by providing an ionized wind when discharging an electrode material, and further when immediately after the discharging, charging on the electrodes to be formed, can be avoided.

With this, it is possible to prevent electrostatic damage or destruction of the discharging head 34, and furthermore, a productivity of the electronic device being produced can be enhanced, and also the reliability can be enhanced.

Next, as a fourth application of the present invention, a manufacturing example of a color film which is used for a liquid display device, etc., will be explained.

To manufacture a color filter by discharging an ink on the substrate S using the discharging apparatus 30, first, the substrate S is placed on the predetermined location on the table 39. As for the substrate S, a transparent substrate which has adequate mechanical strength and high optical transparence is adopted. Specifically, a transparent glass substrate, an acryl glass, a plastic substrate, a plastic film, and the surface treated products of these, etc., can be adopted.

In addition, in the present example, a plurality of color filter regions are formed in the form of a matrix on a rectangular substrate S from the viewpoint of increasing productivity. These color filter regions can later be used as color filters suitable for a liquid crystal display device by cutting the substrate S. Color filter regions are arranged by respectively forming red (R), green (G) and blue (B) ink into predetermined patterns, and in this example, a striped pattern is conventional. Furthermore, other examples of formed patterns in addition to a striped pattern include mosaic, delta, and square patterns.

Figure 6A:
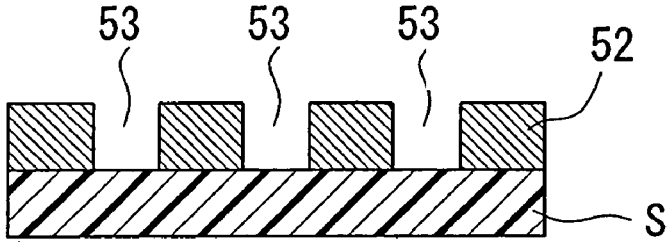
FIGS. 6A through 6F show a method of forming a color filter.

In order to form color filter regions like this, at first, a black matrix 52 is formed with respect to one side of transparent substrate S as shown in FIG. 6A. This black matrix 52 is formed by coating a non-light transmitting resin (preferably black) to a predetermined thickness (e.g., about 2 μm) by a method such as spin coating. The minimum display element, namely filter element 53, surrounded by the matrix of black matrix 52 has, for example, a width in the direction of the X axis of about 30 μm and a length in the direction of the Y axis of about 100 μm.

Figure 6B:
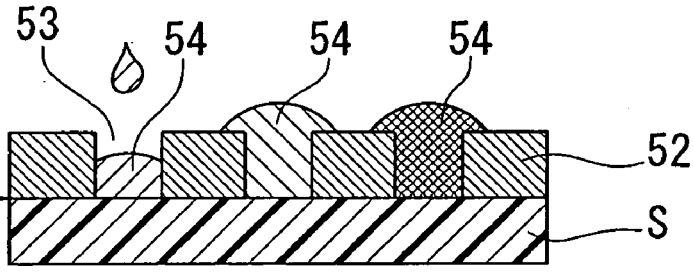

Next, as shown in FIG. 6B, ink droplets (liquid droplets) 54 are discharged from the discharging head 34 and impact on the filter element 53. At the same time, electrostatic charge on the substrate S and electrostatic charge on the black matrix 52 are discharged by providing an ionized wind from the ion producing device 38 before discharging of the ink droplets (liquid droplets) 54. In addition, an ionized wind is provided from the discharging device during discharging the ink droplets (liquid droplets) 54. Such blowing of the ionized wind from the ion producing device 38 is conducted before and after discharging the ink droplets (liquid droplets) 54.

The amount of the discharged ink droplets 54 is an adequate amount in consideration of the reduction in ink volume in the heating step.

Figure 6C:
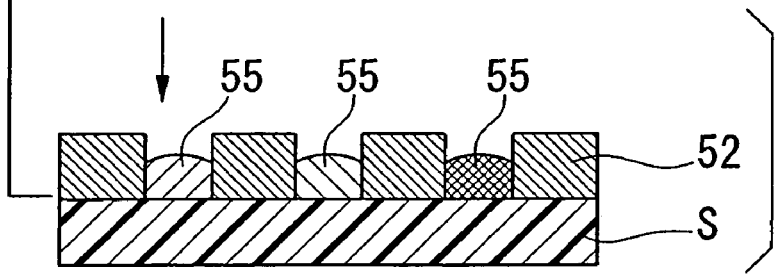

Once ink droplets 54 have been filled into all of the filter elements 53 on the substrate S in this manner, the substrate S is heat-treated to a predetermined temperature (e.g., about 70° C.) using a heater. As a result of this heat treatment, the ink solvent is evaporated and the ink volume decreases. In cases in which this decrease in volume is particularly large, the ink discharge step and heating step are repeated until an adequate ink film thickness is obtained for use as a color filter. As a result of this treatment, the solvent contained in the ink evaporates so that ultimately only the solid component contained in the ink remains in the form of a film, thereby resulting in color filters 55 as shown in FIG. 6C. In the case of repeating the ink discharging process and the heating process, especially in the ink discharging process, an ionized wind is provided from the ion producing device 38 before and after the process.

Figure 6D:
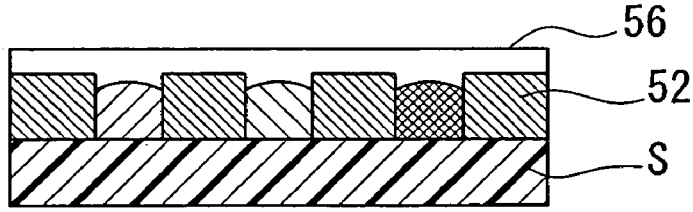

Next, in order to flatten the substrate S and protect the color filters 55, a protection film 56 is formed on the substrate S so as to cover color filters 55 and black matrix 52 as shown in FIG. 6D. Although spin coating, roll coating or lipping and, etc., can be used to form this protection film 56, the discharging apparatus 30 shown in FIG. 1 can also be used in the same manner as in the case of color filters 55. In the case of using the discharging apparatus 30, it is preferable to provide an ionized wind from the ion producing device 38 each time before and after discharging a forming material of the protection film 56.

Figure 6E:
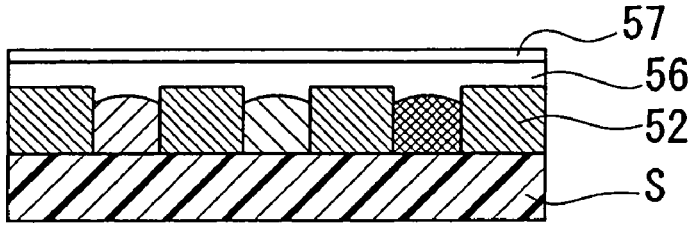
Figure 6F:
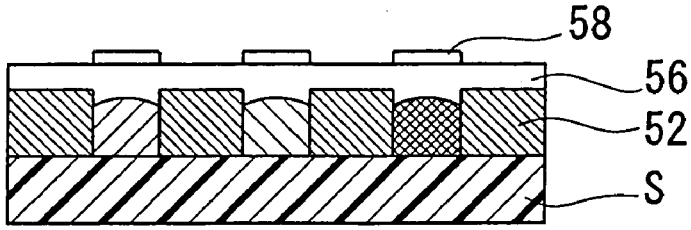

Next, as shown in FIG. 6E, a transparent conductive film 57 is formed over the entire surface of the protective film 56 by sputtering or vacuum vapor deposition, etc. Subsequently, transparent conductive film 57 is patterned and pixel electrodes 58 are patterned corresponding to filter elements 53.

In the manufacture of a color filter using the discharging apparatus 30, electrostatic charge on the substrate S is discharged by providing an ionized wind from the ion producing device 38, and also, charging of the color filter to be formed is prevented by providing an ionized wind at the time of discharging of color filter material (ink droplets 54) and further immediately after the discharging.

In this way, it is possible to prevent electrostatic damage and destruction of the discharging head 34, and furthermore, productivity of the optical device (a liquid display device) being produced can be enhanced, and also the reliability can be enhanced.

Figure 7:
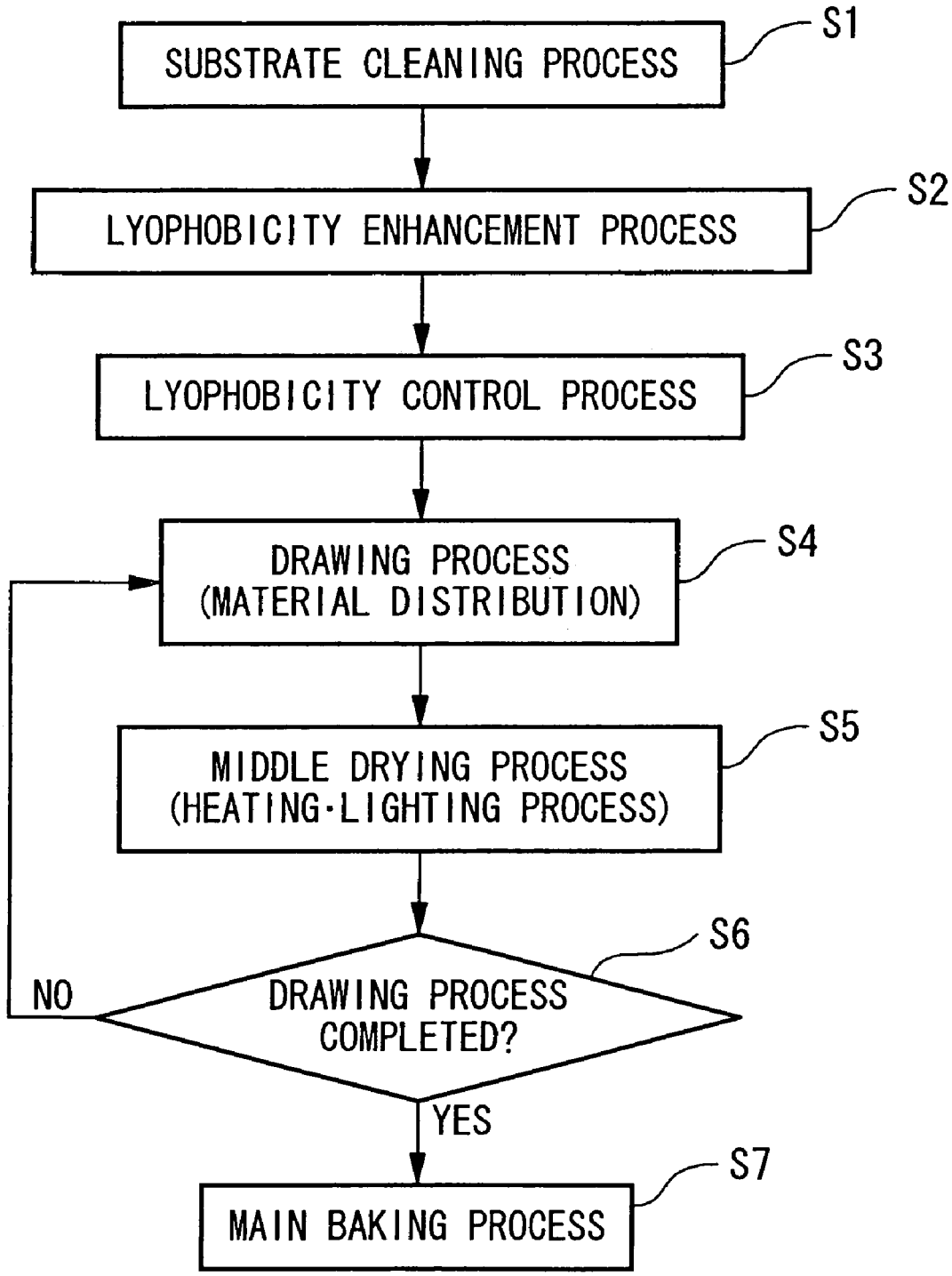
FIG. 7 is a flow chart of a method for forming patterns.

Next, as a fifth application of the present invention, a forming method of a conductive film circuit pattern (metal circuit pattern) will be explained referring to the figures. FIG. 7 is a flow chart to explain a method of forming patterns of the present example.

In FIG. 7, the pattern forming method of the present example has a cleaning process using a predetermined solvent, etc., of a substrate of which liquid droplets of the liquid material will be distributed. (STEP S1), a lyophobicity enhancement process which constitutes one part of the surface treatment process of the substrate (STEP S2), a lyophobicity control treatment process which constitutes one part of the surface treatment process which controls lyophobicity of the substrate surface (STEP S3), a material distribution process for drawing (forming) a film pattern on the surface treated substrate by distributing a liquid material which contains conductive film circuit forming material using a liquid droplet discharging method (STEP 4), an intermediate drying process for removing at least one part of the solvent constituent in the liquid material distributed on the substrate (STEP S5), and a baking process for baking the substrate on which predetermined pattern is drawn (STEP S7). After the intermediate drying process, it is judged whether the predetermined pattern drawing is completed or not (STEP S6), then the baking process will be performed in the case in which the pattern drawing is completed, on the other hand, the material distribution process will be performed in the case in which the pattern drawing is not completed.

Next, the material distribution process (STEP S4) based on the liquid droplet discharging method using the discharging apparatus 30 (STEP S4) will be explained.

The material distribution process of the present example is a process for forming a plurality of linear film patterns (circuit patterns) in lines by distributing a liquid material containing the conductive circuit forming material from the liquid droplets discharging head 34 of the discharging apparatus onto the substrate S. The liquid material is a liquid type material of which a conductive fine particles such as metal, etc., are dispersed in a dispersion medium. In the following explanation, the case of forming three of first, second, and third film patterns (linear patterns) W1, W2, and W3 will be explained.

FIG. 8, FIG. 9, and FIG. 10 are figures for explaining one example of distributing liquid droplets on the substrate S in the present example. In these figures, a bitmap which contains pixels which are a plurality of unit regions in a matrix and liquid droplets will be distributed is set on the substrate S. Here, one pixel is set to as a square shape. First, second, and third patterns forming regions R1, R2, and R3 which form the first, second, and third film patterns W1, W2, and W3 are set so that they correspond to the predetermined pixels in the plurality of pixels. The plurality of pattern forming regions R1, R2, and R3 are set in line along the X-axis direction. In FIG. 8 to FIG. 10, the pattern forming regions R1, R2, and R3 are denoted as shaded regions.

In addition, it is set so that droplets of a liquid material discharged from a first discharging nozzle 34A among a plurality of nozzles equipped on the discharging head 34 of the liquid droplet discharging apparatus will be distributed on the first pattern forming region R1 on the substrate S. Similarly, it is set so that droplets of a liquid material discharged from the second and third discharging nozzle 34B and 34C among a plurality of nozzles equipped on the discharging head 34 of the liquid droplet discharging apparatus will be distributed on the second and third pattern forming regions R2 and R3 on the substrate S.

That is, the discharging nozzles (discharging parts) 34A, 34B, and 34C are provided so that they correspond to each of the first, second, and third pattern forming regions R1, R2, and R3. The discharging heads 34 distribute a plurality of droplets in order on each of a plurality of pixel locations of a plurality of pattern forming regions R1, R2, and R3 which are set.

Furthermore, at each of the first, second, and third pattern forming regions R1, R2, and R3, it is set so that the first, second, and third film patterns W1, W2, and W3 that should be formed on these pattern forming regions R1, R2, and R3 are formed from the first side part pattern Wa which is one side (−X side) in the line width direction, and next, the second side part pattern Wb which is the another side (+X side) is formed, and after forming the first and second side part patterns Wa and Wb, the center pattern Wc which is the center part in the line width direction is formed.

In the present example, each of the film patterns (linear patterns) W1 to W3, that is, each of the pattern forming regions R1 to R3 have the same line width L, and the line width L is set equal to the width of three pixels. Each space part between each pattern is set to the same width S, and the width S is also set to be equal to the width of three pixels. The nozzle pitches which are gaps between the discharging nozzle s34A to 34*c* are set to be equal to the width of six pixels.

In the following description, the discharging head 34 which includes the discharging nozzles 34A, 34B, and 34C will discharge liquid droplets scanning along the Y-axis against the substrate S. In the description using FIG. 6 to FIG. 10, the symbol "1" indicates the liquid droplet which is distributed at the first scan, and the symbols "2", "3", . . . , "n" indicate the liquid droplets which are distributed at the second, third, . . . , and n-th scan.

Figure 8A:
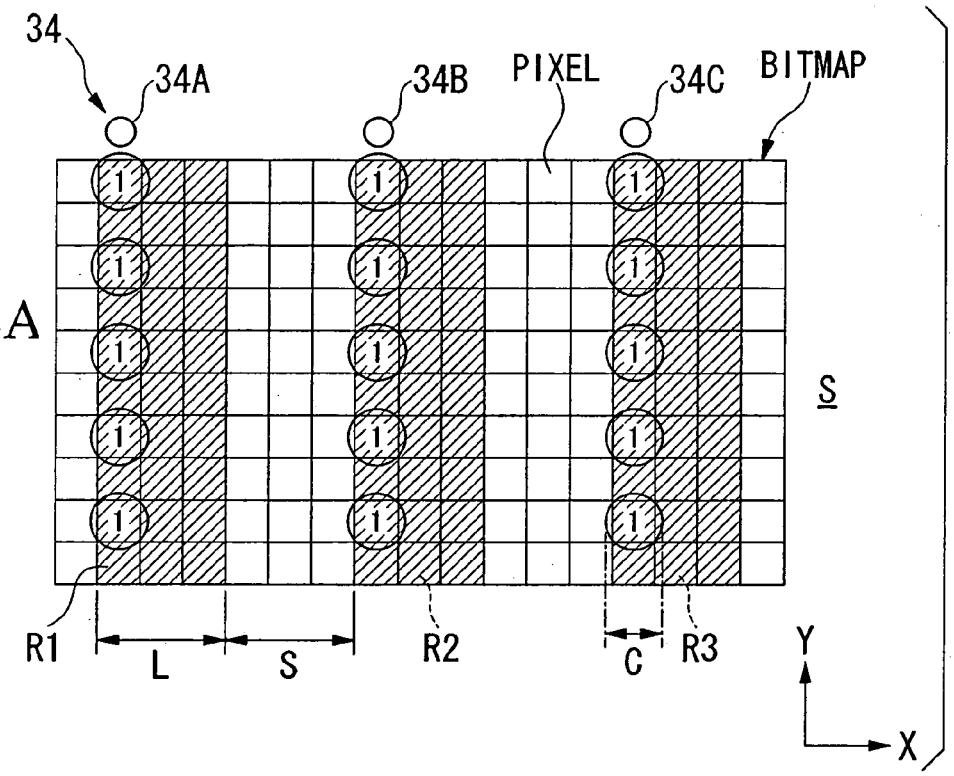
FIGS. 8A and 8B show schematically an example of a method for forming patterns.

As shown in FIG. 8A, in the first scan, to form the first side part pattern Wa for each of the first, second, and third pattern forming regions R1, R2, and R3, liquid droplets are distributed at the same time from the first, second, and third discharging nozzles 34A, 34B, and 34C having a space equal to one pixel on the area of which the first side part pattern forming region will be formed. At the time of discharging liquid droplets from each discharging nozzle 34A, 34B, and 34C, an ionized wind will be provided by the ion producing device 38. Here, the liquid droplets distributed on the substrate S will wet and spread on the substrate S by impacting onto the substrate S. That is, as shown by circles in FIG. 8A, the droplets which impact the substrate S will wet and spread so that they have diameter C which is larger than the size of one pixel. It is set that each liquid droplet distributed on the substrate S will not overlap others because each liquid droplet is distributed along the Y-axis direction with a predetermined gap therebetween. By doing this, a liquid material is prevented from being distributed on the substrate S in excess along the Y-axis direction, and also the producing of bulges can be prevented.

In FIG. 8A, although each liquid droplet is distributed so that they do not overlap each other when they are distributed on the substrate S, each droplet can also be distributed so that they slightly overlap each other. Furthermore, although each liquid droplet is distributed with a gap equal to one pixel in this example, it is acceptable for each droplet to be distributed with a gap equal to an arbitrary number of two or more. In this case, gaps between each liquid droplet on the substrate S can be compensated by increasing the number of scanning operations and distribution operations (discharging operations) of the discharging head 34 onto the substrate S.

The excess spreading of liquid droplets distributed on the substrate S can be prevented because the surface of the substrate S is processed in advance at STEP S2 and STEP 3 to have a predetermined lyophobicity. Therefore, the pattern shapes can be well controlled in good condition, and furthermore, increasing the film thickness can also be easily performed.

Figure 8B:
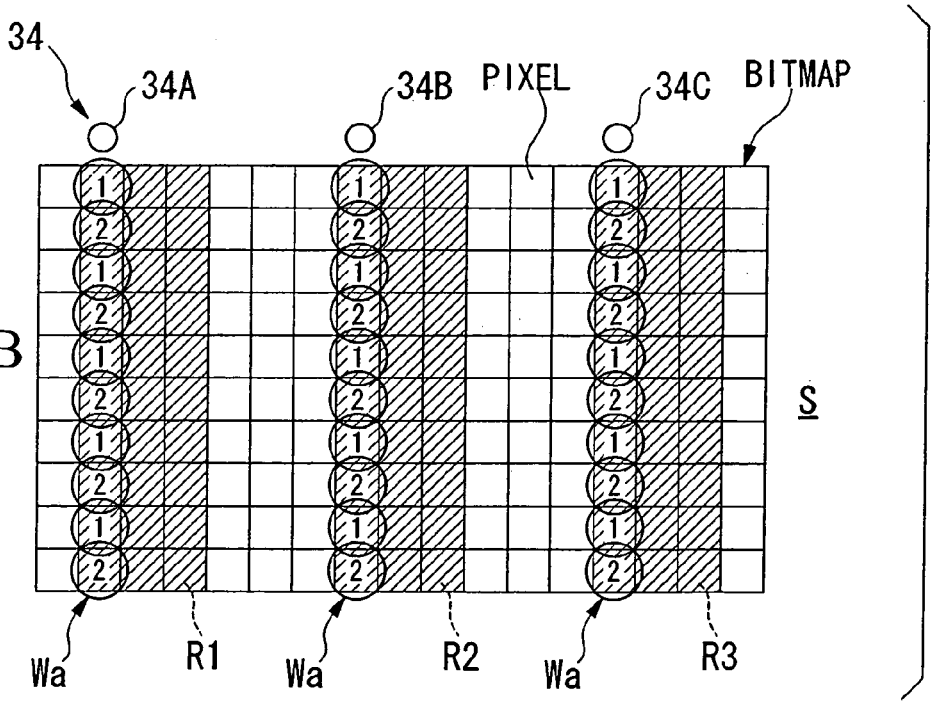

FIG. 8B is a schematic drawing in which liquid droplets are distributed from the discharging head 34 onto the substrate S at the second scanning. In FIG. 8B, the symbol "2" denotes liquid droplets distributed in the second scanning. In the second scanning, liquid droplets are distributed at the same time from each of the discharging nozzles 34A, 34B, and 34C so that they compensate the gaps between the liquid droplets "1" distributed in the first scanning. The first side part patterns Wa are formed at each of the first, second, and third pattern forming regions R1, R2, and R3 by connecting the liquid droplets to each other at the first and second scanning operations and distribution operations. Here, the liquid droplets "2" also wet and spread by impacting on the substrate S, then one part of the liquid droplets "2" and one part of the liquid droplets "1" distributed in advance on the substrate S overlap each other. Specifically, one part of the liquid droplets "2" overlap on the liquid droplets "1". In this second scanning, when liquid droplets are discharged from each of the discharging nozzles 34A, 34B, and 34C, an ionized wind is blown from the ion producing device 38 each time before and after the discharging.

After distributing liquid droplets on the substrate S to form the first side part pattern Wa, the intermediate drying process (STEP S5) can be performed if necessary, to remove the dispersing media. The intermediate drying process can be an optical treatment using a lamp annealing other than a normal heat treatment using a hot plate, an electric furnace, a hot wind blower, and etc.

Figure 9A:
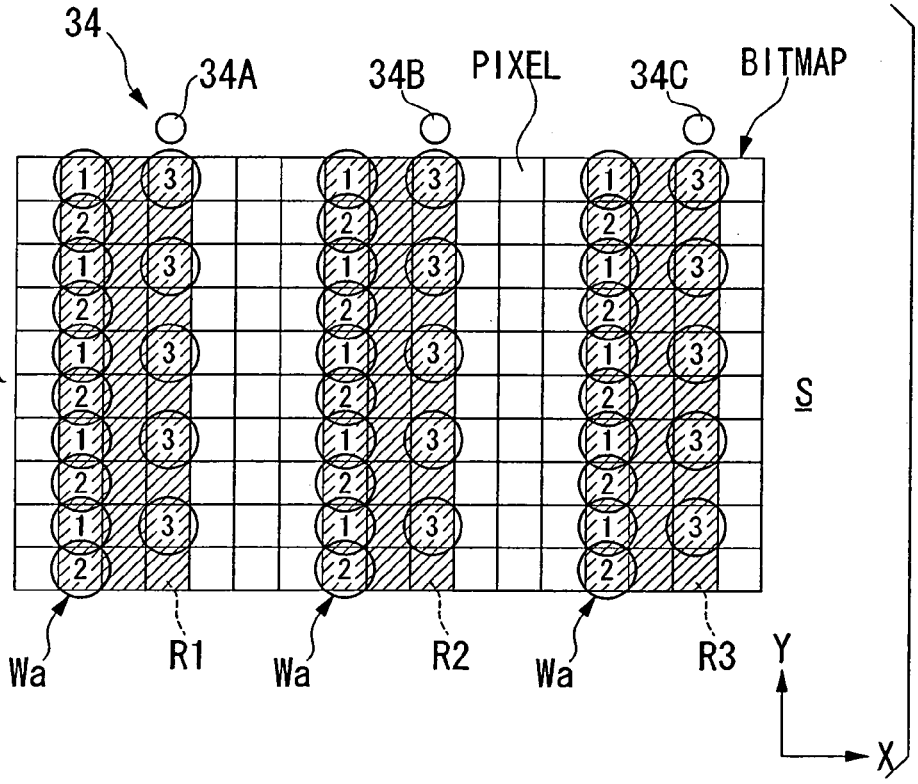
FIGS. 9A and 9B show schematically an example of a method for forming patterns.

Next, the discharging head 34 and the substrate S are relatively moved along the +X-axis direction for a distance just equal to the size of two pixels. Following this, the discharging nozzles 34A, 34B, and 34C also move. Then, the discharging head 34 will perform the third scanning. With this, as shown in FIG. 9A, liquid droplets. "3" which are for forming the second side part pattern Wb which constitutes one part of each film pattern W1, W2, and W3 will be discharged from each nozzle 34A, 34B, and 34C at the same time onto the substrate S with a gap along the X-axis direction against the first side part pattern Wa. The liquid droplets "3" are distributed along the Y-axis direction with a gap of one pixel. In the third scanning, when liquid droplets are discharged from each of the discharging nozzles 34A, 34B, and 34C, an ionized wind is blown from the ion producing device 38 at each time of before and after the discharging.

Figure 9B:
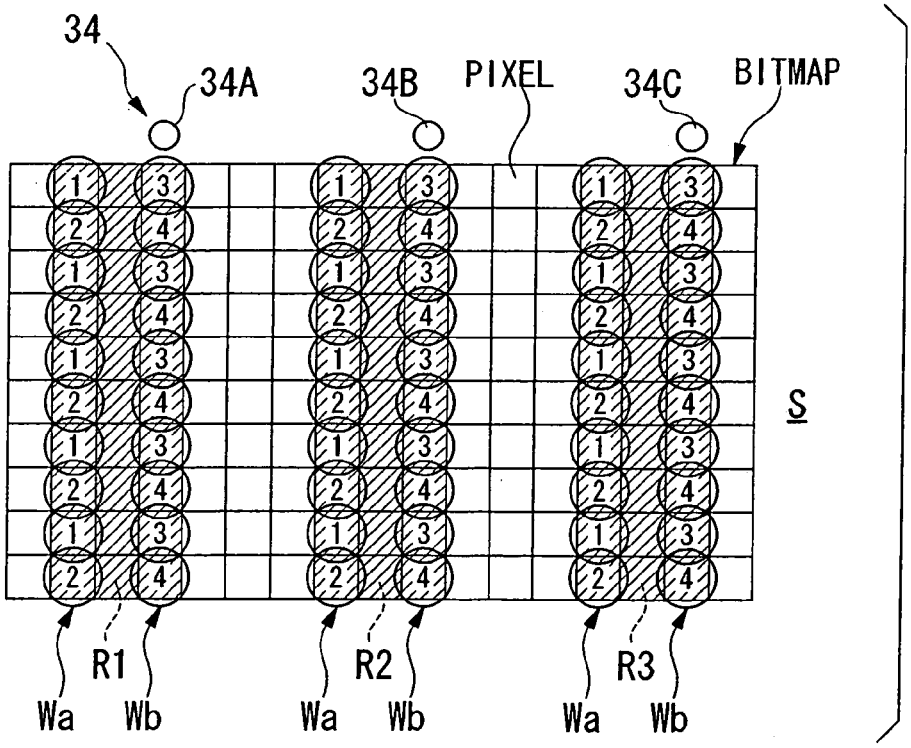

FIG. 9B is a schematic drawing of liquid droplets being distributed from the discharging head 34 onto the substrate S in the fourth scanning. In FIG. 9B, the symbol "4" denotes the liquid droplets distributed in the fourth scanning. In the fourth scanning, liquid droplets are distributed at the same time from each of the discharging nozzles 34A, 34B, and 34C so that they compensate for the gaps between the liquid droplets "3" distributed in the third scanning. The second side part patterns Wb are formed at each of the first, second, and third pattern forming regions R1, R2, and R3 by connecting the liquid droplets to each other at the third and fourth of scanning operations and distribution operations. One part of the liquid droplets "3" and one part of the liquid droplets "4" distributed in advance on the substrate S overlap each other. Specifically, one part of the liquid droplets "4" overlap on the liquid droplets "3". In this fourth scanning, when liquid droplets are discharged from each of the discharging nozzles 34A, 34B, and 34C, an ionized wind is blown from the ion producing device 38 at each time of before and after the discharging.

After distributing liquid droplets on the substrate S to form the second side part pattern Wb, the intermediate drying process can be performed if necessary, to remove dispersing media.

Figure 10A:
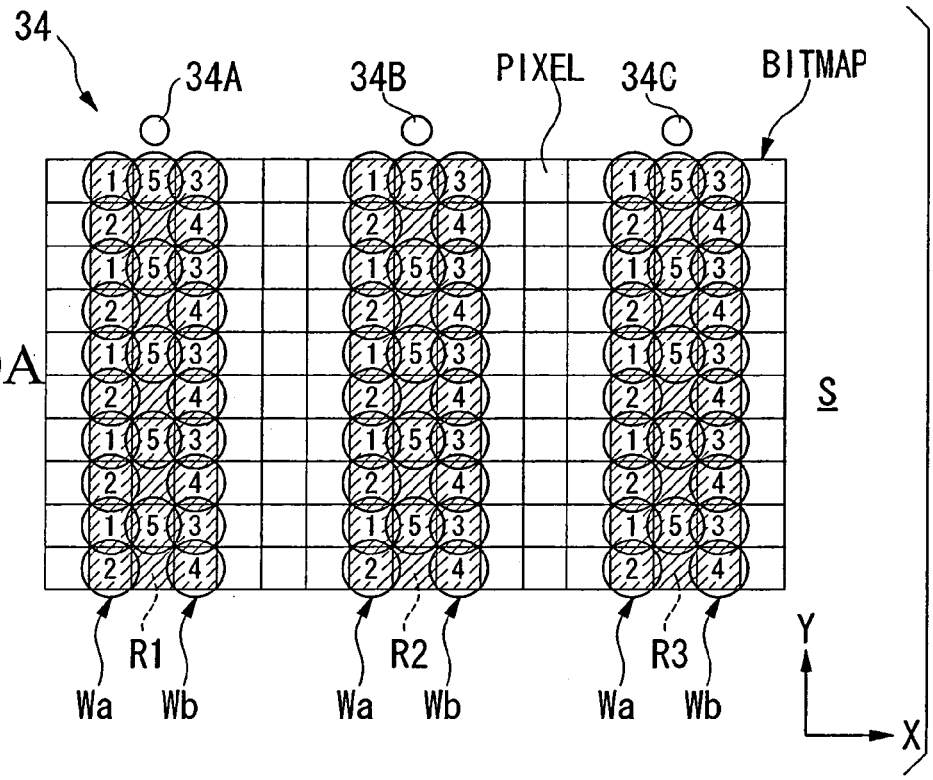
FIGS. 10A and 10B show schematically an example of a method for forming patterns.

Next, the discharging head 34 conducts stepped movement toward the −X-axis direction for a distance just equal to the size of two pixels, and following this, the discharging nozzles 34A, 34B, and 34C also conduct stepped movement toward the −X-axis direction for a distance Just equal to the size of two pixels. Then, the discharging head 34 will conduct the fifth scanning. With this, as shown in FIG. 10A, liquid droplets "5" which are for forming the middle pattern Wc which constitutes one part of each film pattern W1, W2, and W3 will be discharged at the same time onto the substrate S. The liquid droplets "5" are distributed along the Y-axis direction with a gap of one pixel. One part of the liquid droplets "5" and one part of the liquid droplets "1" and "3" distributed in advance on the substrate S overlap each other. Specifically, one part of the liquid droplets "5" overlap on the liquid droplets "1" and "3". In the fifth scanning, when liquid droplets are discharged from each of the discharging nozzles 34A, 34B, and 34C, an ionized wind is blown from the ion producing device 38 at each time of before and after the discharging.

Figure 10B:
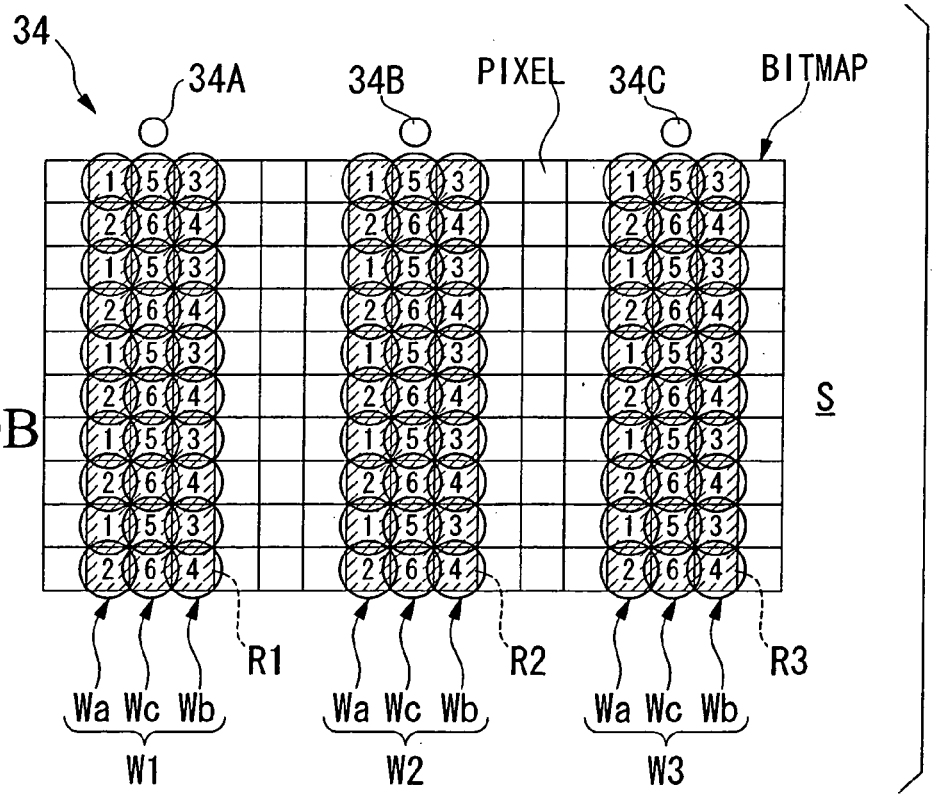

FIG. 10B is a schematic drawing in which liquid droplets are being distributed from the discharging head 34 onto the substrate S in the sixth scanning. In FIG. 10B, the symbol "6" denotes the liquid droplets distributed in the sixth scanning. In the sixth scanning, liquid droplets are distributed at the same time from each of the discharging nozzles 10A, 10B, and 10C so that they compensate the for gaps between the liquid droplets "5" distributed in the fifth scanning. The middle patterns Wc are formed at each of the first, second, and third pattern forming regions R1, R2, and R3 by connecting the liquid droplets to each other in the fifth and sixth of scanning operations and distribution operations. One part of the liquid droplets "6" and one part of the liquid droplets "5" distributed in advance on the substrate S overlap each other. Furthermore, one part of the liquid droplets "6" and one part of the liquid droplets "2" and "4" distributed in advance on the substrate S overlap each other. In this sixth scanning, when liquid droplets are discharged from each of the discharging nozzles 34A, 34B, and 34C, an ionized wind is blown from the ion producing device 38 at each time of before and after the discharging.

By performing the above, the film pattern W1, W2, and W3 will be formed on each of the pattern forming regions R1, R2, and R3.

As explained above, when forming the film patterns W1, W2, and W3 having almost the same shape by distributing a plurality of liquid droplets in order, the distribution orders for distributing liquid droplets toward each of a plurality of pixels of each pattern forming regions R1, R2, and R3 are set to be the same as each other. Therefore, in the case in which each liquid droplet "1" to "6" is distributed so that one part of them overlaps each other, the external shape of each film pattern W1, W2, and W3 can be the same because the overlapping shapes are the same between each film pattern W1, W2, and W3. Therefore, irregular color in appearance between each film pattern W1, W2, and W3 can be prevented.

The distribution of liquid droplets (the overlapping shape between liquid droplets) can be the same because the distribution order of liquid droplets is the same for each of the film patterns W1, W2, and W3. Therefore, producing an irregular color can be prevented.

The film thickness distribution of each film pattern can be almost the same because the overlapping conditions between liquid droplets at the each of film pattern W1, W2, and W3 is set to be the same. Therefore, in the case in which the film patterns are repeat patterns which are repeated along the face direction of the substrate, especially in the case, for example, in which the film patterns are a plurality of patterns provided corresponding to the pixels of the display device, each of the pixels will have the same film thickness distributions. Therefore, the same function can be realized at each location along the face direction of the substrate.

In addition, line widths of each film pattern W1, W2, and W3 can be nearly uniform because liquid droplets "5" and "6" for forming the center pattern Wc are distributed so that they will fill gaps between the first side portion part pattern Wa and the second side portion part pattern Wb after forming the first side portion part pattern Wa and the second side portion part pattern Wb. That is, in the case liquid droplets "1", "2", "3", and "4" for forming the side part patterns Wa, Wb after forming the center pattern Wc on the substrate S, there may be a problem in that line width control for each film pattern W1, W2, and W3 becomes difficult because a phenomenon in which the liquid droplets are drawn toward the center pattern Wc formed on the substrate S will occurs. On the other hand, in the present embodiment, line width control for each film pattern W1, W2, and W3 can be performed precisely because liquid droplets "5" and "6" for forming the center pattern Wc are distributed so that they will fill gaps between the side part pattern Wa and the side part pattern Wb after forming the side part pattern Wa and the side part pattern Wb.

The side part pattern Wa and the side part pattern Wb can be formed after forming the center pattern Wc. In this case, production of an irregular color in appearance between each pattern can be inhibited by applying the same liquid droplets distribution order for each of the film pattern W1 to W3.

In the forming method of such conductive film circuit pattern (metal circuit pattern), electrostatic charge on the substrate S can be discharged by blowing an ionized wind from the ion producing device 38 on the substrate S in advance, and also charging of the conductive film circuit pattern to be formed can be prevented by blowing an ionized wind at the time when liquid material including conductive film circuit forming material is discharged, and furthermore immediately after discharging the liquid material.

With this, electrostatic destruction of the discharging head 34 can be prevented, and furthermore, productivity of the device to be manufactured can be enhanced, and also the reliability can be enhanced.

Next, as the sixth application of the present invention, the surface treatment for an optical part will be explained.

In the present example, an ionized wind is provided on the optical part when a treatment liquid material is coated on the surface to achieve enhancement of the optical performance and function.

As an examples of the optical part which will be a treated object, a wide variety of optical lenses such as a lens for glasses, a lens for lighting control, a lens for sunglasses, a lens for a camera, a lens for a telescope, a lens for a magnifying glass, a lens for a projector, a pick-up lens, a micro lens, etc., can be raised. Also, an optical mirror, an optical filter, a prism, an optical part for a stepper for semiconductor exposure, an organic cover glass of a mobile device, etc., can be raised as the examples.

As for the surface treatment for such an optical part, specifically, hard coat treatment, antireflection treatment, etc., can be mentioned as the examples. As for the treatment material for such surface treatment, one part of the raw material of the optical part, a unprocessed part of the optical part, one part of the surface hardening raw material of the optical part, a surface hardening raw material of the optical part, one part of primer raw material of the optical part, a primer raw material of the optical part, one part of antireflection film raw material of the optical part, an antireflection film raw material of the optical part, etc., can be mentioned as examples.

The raw material compositions of the treatment liquid material is selected according to the hardening method. For example, in a case of hardening a raw material for an optical part, a surface hardening film raw material, a primer raw material, and an antireflection film raw material using ultraviolet light, electron beam, microwave, etc., because the hardening reaction can progress without adding a reaction starting liquid, a catalyst, a solvent, water for progressing hydrolysis reaction, one part of optical part raw material except them, one part of surface hardening film raw material, one part of primer raw material, and one part of antireflection film raw material can be used.

On the other hand, in the case of hardening a raw material for an optical part, a surface hardening film raw material, a primer raw material, and an antireflection film raw material, because hardening process will not progress without a reaction starting liquid, a catalyst, a solvent, water for progressing hydrolysis reaction, it is necessary to use optical part raw material containing them, surface hardening film raw material, primer raw material, and antireflection film raw material. It is also possible to color by containing dye and/or pigment in the treatment liquid material.

For coating the treatment liquid material for such surface treatment, the substrate transfer device 32 as the discharging apparatus 30 in particular, may be constituted so that the table 39 can index (rotation index) by rotating an optical part along the θ direction using a motor for θ axis (not shown in the figures).

Figure 11A:
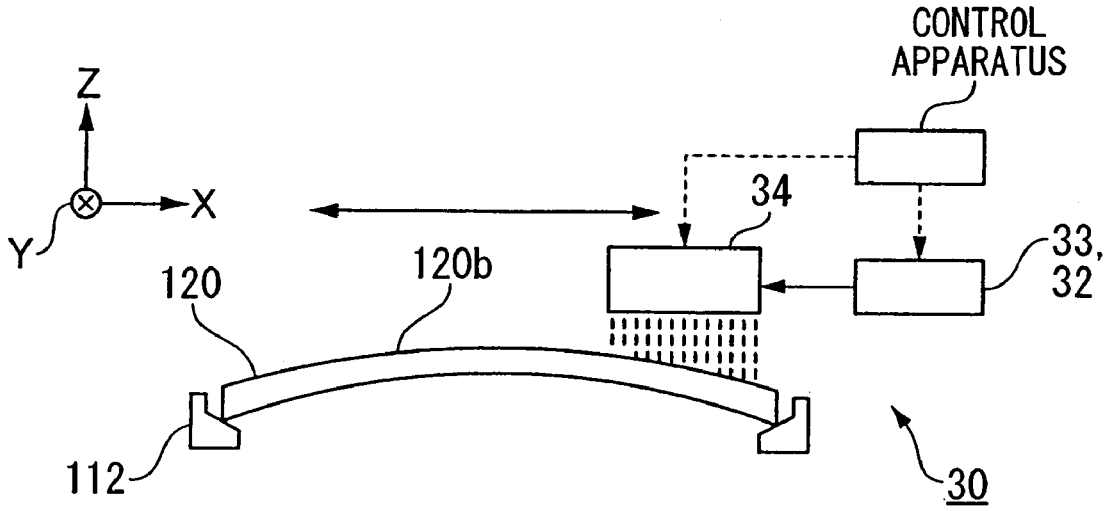
FIGS. 11A and 11B show surface treatment of an optical part.

In the present example, within the treatment materials, hard coating liquid (hard coating composition) is coated on the curved face of an optical part which will be a substrate. That is, as shown in FIG. 11A, a coating film will be formed on a curved face 120*a* by discharging the hard coating liquid as a liquid droplets which is the treatment liquid from the plurality of nozzles equipped on the discharging head 34 while relatively moving the optical part 120 and the discharging head 34 in the state of holding the optical part 120 by holding part 112, and by repeatedly applying the liquid droplets on the curved face 120*a* of an optical part 120

In the present example, most of the treatment liquid coated on the curved face 120*a* of the optical part 120 remains on the curved face 120*a* as it was, and the usage efficiency is high because the treatment liquid is coated in a liquid droplet manner. In the present example, the optical part 120 is placed so that the curved face 120*a* of convex shape faces upward, and the hard coating liquid is discharged downward from the discharging head 34 placed above the optical apparatus 120. In addition, when liquid droplets are discharged from the discharging head 34, an ionized wind from the ion producing device 38 will be provided to the optical part 120 before and after discharging the liquid droplets.

Figure 11B:
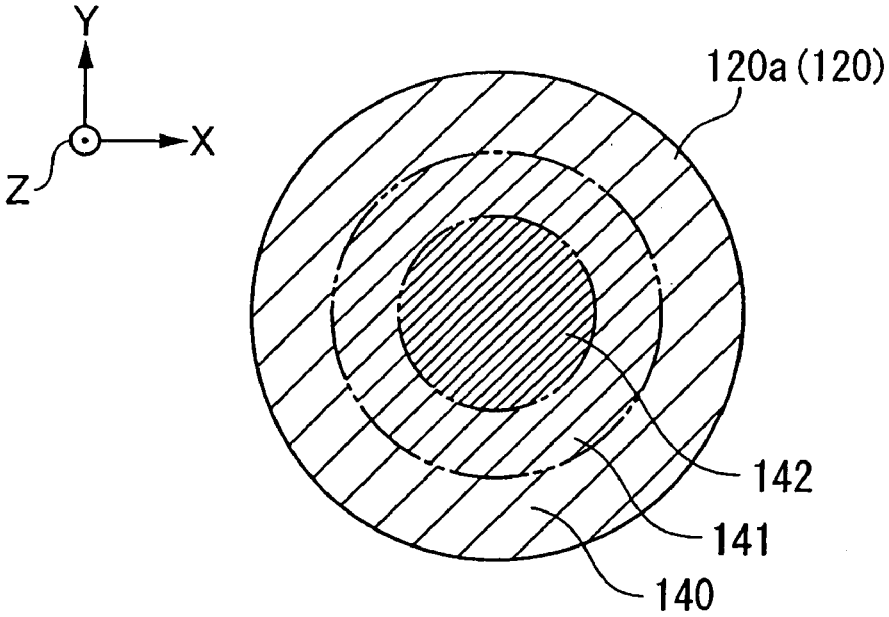

In the present example, when coating the treatment liquid, the curved face 120*a* of the optical part 120 is divided into a plurality of regions, and the coating amount of the treatment liquid is controlled for each region. Specifically, as shown in FIG. 11B, the curved face 120*a* of the optical part 120 which is a coating object is divided into a plurality of regions having concentric circle shapes and the vertex as the center (here, three regions 140, 141, and 142), and in the plurality of regions 140, 141, and 142, set the coating amount of treatment liquid (the amount of treatment liquid per area) at inner side regions are larger than at the outer side regions. That is, in the example of FIG. 11B, coating amount to the most outer side region 140 is lowest, and the coating amount increases in step toward the inner side, in the order of region 141 and region 142.

In the present example, one part of the treatment liquid material coated on the curved face 120*a* moves from the near of center portion which is the inner side of the curved face 120*a* by the effect of gravity toward the outer side because the curved face 120*a* of the optical part 120 which is a coated object being placed so that the curved face 120*a* will be a convex shape facing upward along the vertical direction. The coating film will be flattened because the amount of the treatment liquid material per area becomes uniform within the curved face 120*a* by one part of the treatment liquid material moves from the inner side to the outer side on the curved faces 120*a* because the coating amount for the inner side regions are larger than for the outer side regions. Therefore, in the coating method of the present example, the difference in film thickness by the effect of gravity between the upper part region and the lower part region of the curved face 120*a* can be inhibited.

Figure 12A:
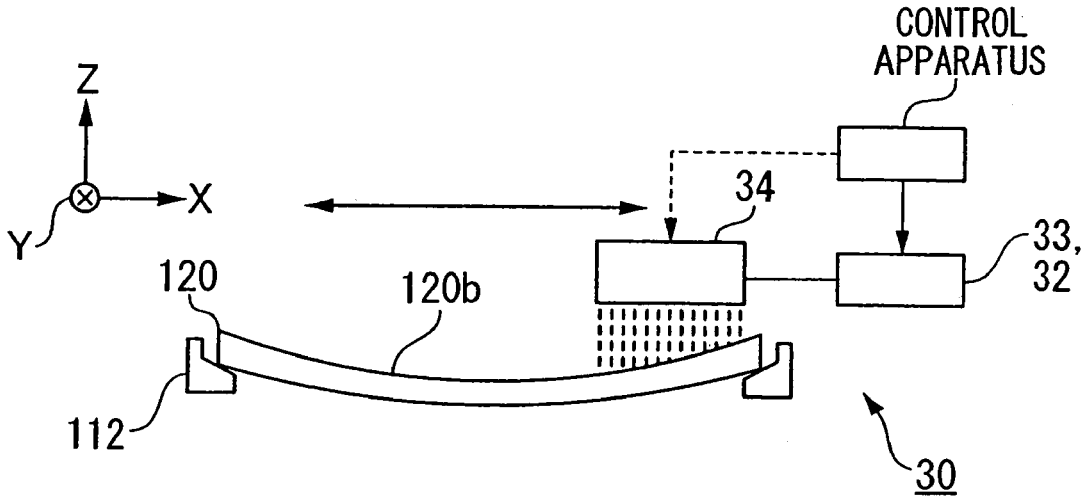
FIGS. 12A and 12B show surface treatment of an optical part.
Figure 12B:
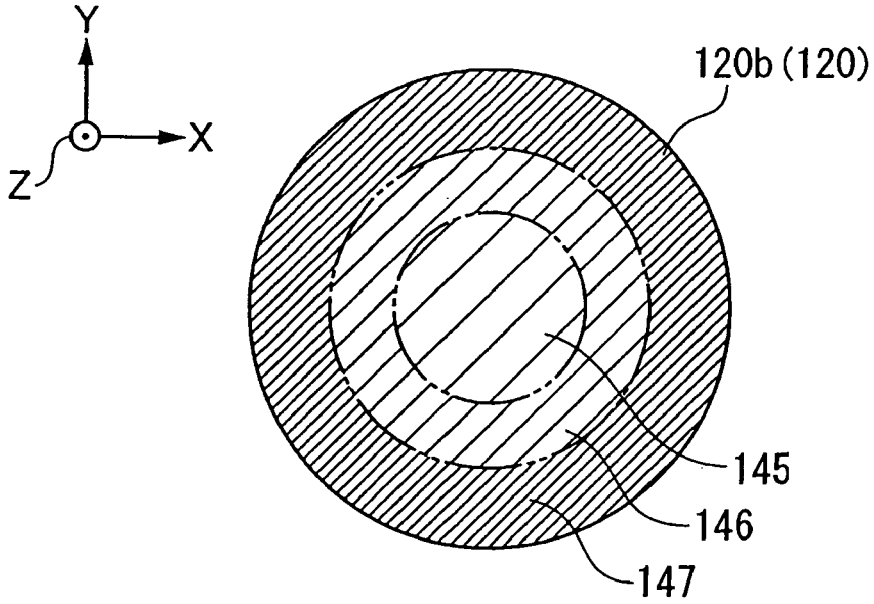

Next, FIGS. 12A and 12B show an example of coating the treatment liquid material in the case in which the curved face 120*b* having concave shape within the surfaces of the optical part 120 is placed upward along the vertical direction.

In the present example, as shown in FIG. 12A, the optical part 120 is placed so that the curved face having a concave shape faces upward, and the hard coating liquid which is the treatment liquid material is discharged downward from the discharging head 34 placed on the above of the optical part 120. When discharging liquid droplets from the discharging head 34, an ionized wind is provided from the ion producing device 38 to the optical parts 120 before and after discharging the liquid droplets.

In addition, when coating, as shown in FIG. 12B, the concave curved face 120*b* of the optical part 120 which is a coated object is divided into a plurality of regions (here, three regions 145, 146, and 147) having concentric circle shapes and the lowest point as the center, and within the plurality of regions 145, 146, and 147, the coating amount of treatment liquid material at the outer side regions are larger than at the inner side regions. That is, the coating amount at the most inner side region 145 is lowest, and the coating amount increases in step toward the outer side, in the order of region 146 and region 147.

In the present example, one part of the treatment liquid material coated on the curved face 120*b* moves from the outer side to near of center portion of the curved face 120*b* which is the inner side by the effect of gravity because the curved face 120*b* of the optical part 120 which is a coated object is placed so that the curved face 120*b* will be a concave shape facing upward along the vertical direction. In addition, the coating film will be flattened because the amount of the treatment liquid material per area becomes uniform within the curved face 120*b* by one part of the treatment liquid material moving from the outer side to the inner side on the curved faces 120*b* because the coating amount for the outer side regions are larger than for the inner side regions. Therefore, in the coating method of the present example, the same as in the example in FIG. 11, the difference in film thickness by the effect of gravity between the upper part region and the lower part region of the curved face 120*b* can be inhibited.

In the examples shown in FIG. 11 and FIG. 12, although the curved face is divided into three regions, it is not limited to the three regions, and it is acceptable to divide it into two or four or more regions. In the case of dividing the curved face into a plurality of regions concentrically, it is not necessary to match the centers of each regions properly. Furthermore, the division method is not limited to the concentric style, and an arbitrary method can be adopted.

The division of the curved face can be set corresponding to the shape of the curved face. For example, in the case in which the radius of curvature of the curved face is small and the treatment liquid material easily flows on the curved face, it will be better to divide the curved face into smaller regions. In the case in which the optical part has a multiplex curved face including convex shaped face and concave shaped face, it will be better to divide the curved face into smaller regions corresponding to the shape of the curved face.

The coating amount for each divided region is decided so that the film thickness after drying becomes uniform based on the characteristics of the treatment liquid material such as desired film thickness, radius of curvature and placing angle of the curved face, evaporation rate, etc., and also based on the drying conditions, etc. The coating amount for each region can be controlled by changing the volume per liquid droplet discharged from the liquid material discharging head, and by changing gaps between the liquid droplets, and also by changing the number of coatings.

In the surface treatment for such optical part, electrostatic charge on the optical part is discharged by blowing in advance an ionized wind from the ion producing device 38 toward the optical part 120 which will be a substrate. In addition, charging of the optical part to be formed is prevented by providing an ionized wind at the time the surface treatment liquid is discharged, and furthermore immediately after discharging the treatment liquid.

By doing this, electrostatic damage or destruction of the discharging head 34 can be prevented, and furthermore, the productivity of the produced optical apparatus can be enhanced, and also the reliability can be enhanced.

Moreover, as for the device and the electronic device for which the present invention will be adopted, it is not limited to these devices, and it is possible to manufacture a wide variety of devices such as, for example, an electronic migration device, an organic EL display device, an electron discharging element (including FED and SED), an electronic optical device such as a liquid display device, a wide variety of semiconductor devices, etc.

Next, one example of an electronic device of which one part of the constituent elements is formed by the discharging apparatus will be explained.

Figure 13:
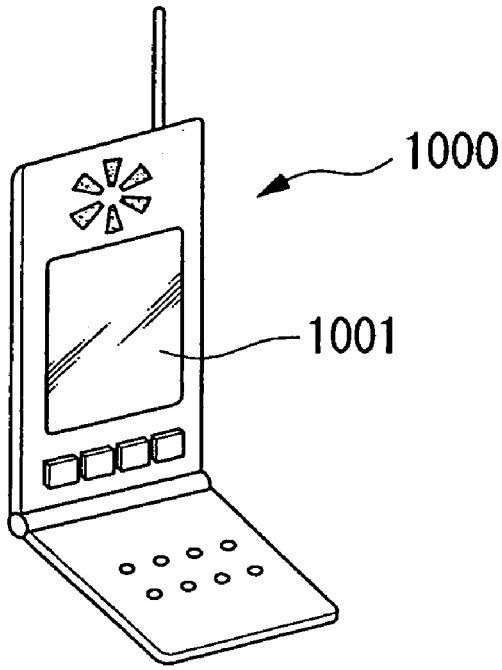
FIG. 13 is a figure showing an example of an electronic device in a perspective view.

FIG. 13 is a perspective view showing an example of a cellular telephone as one example of such an electronic device. In FIG. 13, reference symbol 1000 indicates a cellular telephone body, while reference symbol 1001 indicates a display section made using the organic EL apparatus 301.

The electronic device (cellular telephone) has good productivity at the display section in particular and also has high reliability because it has a display section made of the organic EL device.

What is claimed is:

1. A method for discharging a liquid material comprising:

discharging a liquid material onto a substrate from a discharging apparatus having a discharging head which discharges the liquid material; and providing an ionized wind onto the substrate before the discharging of the liquid material onto the substrate, and at least after the discharging of the liquid material onto the substrate, wherein the liquid material is made of easily chargeable constituent elements.

2. The discharging method for a liquid material according to claim 1, wherein the substrate includes a plurality of easily chargeable constituent elements.

3. The discharging method for a liquid material according to claim 2, wherein at least one of the easily chargeable constituent elements is an active element.

4. The discharging method for a liquid material according to claim 1, wherein the liquid material composed of the easily chargeable constituent elements is a metal wiring material.

5. An electronic device in which one part of a constituent element is formed using the discharging method according to claim 1.

6. An electronic device in which at least one part thereof is made using a discharging apparatus of a liquid material, the discharging apparatus comprising:

a substrate holding part for holding a substrate which includes easily chargeable constituent elements;

a discharging head for discharging the liquid material onto the substrate; and an ionized wind producing unit for providing an ionized wind on the substrate, at least after the discharging head discharges the liquid material onto the substrate.

7. A discharging apparatus for a liquid material comprising:

a substrate holding part for holding a substrate;

a discharging head for discharging the liquid material onto the substrate; and an ionized wind producing unit for providing an ionized wind onto the substrate, wherein the liquid material is an easily chargeable material; and the ionized wind producing unit provides the ionized wind onto the substrate, at least after the discharging head discharges the liquid material onto the substrate.

* * * * *